US005827015A

United States Patent [19]

Woolford et al.

[11] Patent Number: 5,827,015

[45] Date of Patent: Oct. 27, 1998

[54] COMPOSITE MASONRY BLOCK

[75] Inventors: Michael E. Woolford, Lake Elmo, Minn.; Dick J. Sievert, New Richmond, Wis.

[73] Assignee: Anchor Wall Systems, Inc., Minneapolis, Minn.

[21] Appl. No.: 921,481

[22] Filed: Sep. 2, 1997

Related U.S. Application Data

[63] Continuation of Ser. No. 675,572, Jul. 3, 1996, which is a continuation of Ser. No. 469,795, Jun. 6, 1995, Pat. No. 5,589,124, which is a continuation of Ser. No. 157,830, Nov. 24, 1993, which is a division of Ser. No. 651,322, Feb. 6, 1991, Pat. No. 5,294,216, which is a division of Ser. No. 534,831, Jun. 7, 1990, Pat. No. 5,062,610, which is a continuation-in-part of Ser. No. 413,400, Sep. 27, 1989, which is a continuation-in-part of Ser. No. 413,050, Sep. 27, 1989, abandoned.

[51] Int. Cl.[6] ..... E02D 29/02

[52] U.S. Cl. ..... 405/286; 52/608; 405/284

[58] Field of Search ..... 405/286, 284, 405/285, 262, 258; 52/611, 608

[56] References Cited

U.S. PATENT DOCUMENTS

| | | | |
|---|---|---|---|
| 126,547 | 5/1872 | Hickcox . | |
| 228,052 | 5/1880 | Frost . | |
| D. 237,704 | 11/1975 | Lane | D18/2 R |

(List continued on next page.)

FOREIGN PATENT DOCUMENTS

| | | |
|---|---|---|
| 548462 | 2/1980 | Australia . |
| B-67477/81 | 2/1981 | Australia . |
| 22397/83 | 6/1985 | Australia . |
| 52765/86 | 8/1986 | Australia . |
| 80775/87 | 4/1988 | Australia . |
| D. 50020 | of 0000 | Canada . |
| 338139 | 12/1933 | Canada . |

(List continued on next page.)

OTHER PUBLICATIONS

U.S. Copyright Registration TX 2 807 652.
U.S. Copyright Registration TX 2 798 584.
Keystone internal memorandum, Mar. 21, 1989, Dave Jenkyns to Dave Bear.
letter, Mar. 21, 1989, David Bear to Tim Bakke.
drawing, Mar. 22, 1989, "Garden Unit".
letter, Mar. 29, 1989, Cynthia A. Verdine to Paul Forsberg, with enclosed quote.
letter, Mar. 29, 1989, Cynthia A. Verdine to Paul Forsberg.
drawing, 890331, "Garden Unit".
Keystone internal memorandum, Apr. 28, 1989, Dave Jenkyns to Dave Bear.
"3 easy holdups", from Jul. 1989 issue of *Popular Science*.
Minn Key Licensee Monthly Report for the period May 1, 1990 through May 31, 1990.
Minn Key Licensee Monthly Report for the Period Jun. 1, 1990 through Jun. 30, 1990.

(List continued on next page.)

*Primary Examiner*—Dennis L. Taylor
*Attorney, Agent, or Firm*—Merchant, Gould, Smith, Edell, Welter & Schmidt, P.A.

[57] ABSTRACT

The present invention includes block molds and manufacturing processes as well as a composite masonry block comprising a block body having an irregular trapezoidal shape and comprising a front surface and a back surface, an upper surface and a lower surface, and first and second sidewalls. Both the first and second sidewalls have a first and second part, the sidewall first part extends from the block front surface towards the block back surface at an angle of no greater than ninety degrees in relationship to the block front surface, the sidewall second part surfaces adjoins and lies between the sidewall first parts and the block back surface. The block also has a flange extending from the block back surface past the height of the block.

Also disclosed are landscaping structures such as a retaining wall comprising a plurality of the composite masonry blocks of the present invention.

51 Claims, 5 Drawing Sheets

U.S. PATENT DOCUMENTS

| | | | |
|---|---|---|---|
| D. 279,030 | 5/1985 | Risi et al. | D25/80 |
| D. 280,024 | 8/1985 | Risi et al. | D25/80 |
| D. 284,109 | 6/1986 | Seal, Jr. | D26/72 |
| D. 295,788 | 5/1988 | Forsberg | D25/113 |
| D. 295,790 | 5/1988 | Forsberg | D25/116 |
| D. 296,007 | 5/1988 | Forsberg | D25/116 |
| D. 296,365 | 6/1988 | Forsberg | D25/116 |
| D. 297,464 | 8/1988 | Forsberg | D25/114 |
| D. 297,574 | 9/1988 | Forsberg | D25/114 |
| D. 297,767 | 9/1988 | Forsberg | D25/58 |
| D. 298,463 | 11/1988 | Forsberg | D25/114 |
| 298,463 | 11/1884 | Forsberg . | |
| D. 299,067 | 12/1988 | Forsberg | D25/58 |
| D. 299,069 | 12/1988 | Risi et al. | D25/157 |
| D. 300,253 | 3/1989 | Forsberg | D25/114 |
| D. 300,254 | 3/1989 | Forsberg | D25/114 |
| D. 301,064 | 5/1989 | Forsberg | D25/116 |
| D. 311,444 | 10/1990 | Forsberg | D25/113 |
| D. 316,904 | 5/1991 | Forsberg | D25/114 |
| D. 317,048 | 5/1991 | Forsberg | D25/114 |
| D. 317,209 | 5/1991 | Forsberg | D25/114 |
| D. 380,560 | 7/1997 | Forsberg | D25/113 |
| 468,838 | 2/1892 | Steiger . | |
| 566,924 | 9/1896 | Morrin . | |
| 810,748 | 1/1906 | Haller et al. . | |
| 831,077 | 9/1906 | Johnson . | |
| 847,476 | 3/1907 | Hodges . | |
| 884,354 | 4/1908 | Bertrand . | |
| 916,756 | 3/1909 | Grant . | |
| 1,002,161 | 8/1911 | Lambert . | |
| 1,092,621 | 4/1914 | Worner . | |
| 1,219,127 | 3/1917 | Marshall . | |
| 1,222,061 | 4/1917 | Bartells . | |
| 1,248,070 | 11/1917 | Buente . | |
| 1,285,458 | 11/1918 | Strunk . | |
| 1,287,055 | 12/1918 | Lehman . | |
| 1,330,884 | 2/1920 | McDermott . | |
| 1,414,444 | 5/1922 | Straight . | |
| 1,419,805 | 6/1922 | Bigler . | |
| 1,456,498 | 5/1923 | Binns . | |
| 1,465,608 | 8/1923 | McCoy . | |
| 1,472,917 | 11/1923 | Laird . | |
| 1,557,946 | 10/1925 | Smith . | |
| 1,695,997 | 12/1928 | Evers et al. . | |
| 1,727,363 | 9/1929 | Bone . | |
| 1,733,790 | 10/1929 | Gilman . | |
| 1,751,028 | 3/1930 | Casell et al. . | |
| 1,773,579 | 8/1930 | Flath . | |
| 1,907,053 | 5/1933 | Flath . | |
| 1,993,291 | 3/1935 | Vermont . | |
| 2,011,531 | 8/1935 | Tranchell . | |
| 2,034,851 | 3/1936 | Wichmann . | |
| 2,094,167 | 9/1937 | Evers . | |
| 2,113,076 | 4/1938 | Bruce . | |
| 2,121,450 | 6/1938 | Sentrop . | |
| 2,149,957 | 3/1939 | Dawson . | |
| 2,197,960 | 4/1940 | Alexander . | |
| 2,219,606 | 10/1940 | Schoick . | |
| 2,235,646 | 3/1941 | Schaffer . | |
| 2,313,363 | 3/1943 | Schmitt . | |
| 2,371,201 | 3/1945 | Wells . | |
| 2,570,384 | 10/1951 | Russell . | |
| 2,593,606 | 2/1952 | Price . | |
| 2,683,916 | 7/1954 | Kelly . | |
| 2,881,753 | 4/1959 | Entz . | |
| 2,882,689 | 4/1959 | Huch et al. . | |
| 2,892,340 | 6/1959 | Fort . | |
| 2,925,080 | 2/1960 | Smith . | |
| 2,963,828 | 12/1960 | Belliveau . | |
| 3,036,407 | 5/1962 | Dixon . | |
| 3,091,089 | 5/1963 | Gellerstad | 405/206 |
| 3,185,432 | 5/1965 | Hager, Jr. . | |
| 3,204,316 | 9/1965 | Jackson . | |
| 3,274,742 | 9/1966 | Paul, Jr. et al. | 52/245 |
| 3,378,885 | 4/1968 | Dart . | |
| 3,386,503 | 6/1968 | Corning et al. . | |
| 3,390,502 | 7/1968 | Carroll | 52/424 |
| 3,392,719 | 7/1968 | Clanton et al. . | |
| 3,430,404 | 3/1969 | Muse | 52/439 |
| 3,488,964 | 1/1970 | Kubo . | |
| 3,557,505 | 1/1971 | Kaul | 52/275 |
| 3,631,682 | 1/1972 | Hilfiker et al. . | |
| 3,659,077 | 4/1972 | Olson . | |
| 3,667,186 | 6/1972 | Kato . | |
| 3,754,499 | 8/1973 | Heisman et al. . | |
| 3,783,566 | 1/1974 | Nielson | 52/232 |
| 3,797,256 | 3/1974 | Gibion | 405/196 |
| 3,888,060 | 6/1975 | Haener . | |
| 3,925,994 | 12/1975 | Broms et al. . | |
| 3,932,098 | 1/1976 | Huber et al. | 425/412 |
| 3,936,987 | 2/1976 | Calvin | 52/309 |
| 3,936,989 | 2/1976 | Hancock | 52/593 |
| 3,953,979 | 5/1976 | Kurose . | |
| 3,981,038 | 9/1976 | Vidal . | |
| 3,995,434 | 12/1976 | Kato et al. . | |
| 4,001,988 | 1/1977 | Riefler | 52/125 |
| 4,016,693 | 4/1977 | Warren | 52/405 |
| 4,023,767 | 5/1977 | Fontana | 249/52 |
| 4,051,570 | 10/1977 | Hilfiker . | |
| 4,067,166 | 1/1978 | Sheahan | 52/593 |
| 4,083,190 | 4/1978 | Pey . | |
| 4,098,040 | 7/1978 | Riefler | 52/125 |
| 4,098,865 | 7/1978 | Repasky . | |
| 4,107,894 | 8/1978 | Mullins | 52/593 |
| 4,110,949 | 9/1978 | Cambiuzzi et al. | 52/437 |
| 4,114,773 | 9/1978 | Sekiguchi . | |
| 4,117,691 | 10/1978 | Spray | 405/205 |
| 4,124,961 | 11/1978 | Habegger | 52/592 |
| 4,126,979 | 11/1978 | Hancock | 52/594 |
| 4,132,492 | 1/1979 | Jenkins | 404/119 |
| 4,145,454 | 3/1979 | Dea et al. . | |
| 4,158,516 | 6/1979 | Noblanc et al. | 405/200 X |
| 4,175,888 | 11/1979 | Ijima | 405/31 |
| 4,181,453 | 1/1980 | Vache | 405/205 X |
| 4,186,540 | 2/1980 | Mullins | 52/593 |
| 4,187,069 | 2/1980 | Mullins | 425/470 |
| 4,190,384 | 2/1980 | Neumann | 405/284 |
| 4,193,718 | 3/1980 | Wahrendorf et al. | 405/286 |
| 4,207,718 | 6/1980 | Schaaf et al. | 52/585 |
| 4,208,850 | 6/1980 | Collier | 52/285 |
| 4,214,655 | 7/1980 | Bernham et al. | 198/374 |
| 4,217,848 | 8/1980 | Meyer-Haake | 405/196 X |
| 4,218,206 | 8/1980 | Mullins | 425/253 |
| 4,228,628 | 10/1980 | Schlomann | 52/438 |
| 4,229,123 | 10/1980 | Heinzmann . | |
| 4,238,105 | 12/1980 | West . | |
| 4,242,299 | 12/1980 | Adams . | |
| 4,250,863 | 2/1981 | Gagnon . | |
| 4,262,463 | 4/1981 | Hapel | 52/98 |
| 4,266,887 | 5/1981 | Corder | 405/208 X |
| 4,288,960 | 9/1981 | Auras | 52/604 |
| 4,312,606 | 1/1982 | Sarikelle | 405/286 |
| 4,314,431 | 2/1982 | Rabassa | 52/259 |
| 4,319,440 | 3/1982 | Rassias et al. . | |
| 4,324,505 | 4/1982 | Hammett . | |
| 4,335,549 | 6/1982 | Dean, Jr. | 52/98 |
| 4,337,605 | 7/1982 | Tudek | 52/293 |
| 4,372,091 | 2/1983 | Brown et al. . | |
| 4,380,409 | 4/1983 | O'Neill | 405/273 |
| 4,384,810 | 5/1983 | Neumann | 405/284 |
| 4,426,176 | 1/1984 | Terada . | |
| 4,426,815 | 1/1984 | Brown | 52/100 |

| | | | |
|---|---|---|---|
| 4,449,857 | 5/1984 | Davis . | |
| 4,451,174 | 5/1984 | Wetmore | 405/196 |
| 4,454,699 | 6/1984 | Strobl | 52/585 |
| 4,470,728 | 9/1984 | Broadbent | 405/284 |
| 4,490,075 | 12/1984 | Risi et al. | 405/273 |
| 4,496,266 | 1/1985 | Ruckstuhl | 404/41 |
| 4,512,685 | 4/1985 | Hegle | 405/284 |
| 4,524,551 | 6/1985 | Scheiwiller | 52/98 |
| 4,565,043 | 1/1986 | Mazzarase | 52/593 |
| 4,572,699 | 2/1986 | Rinninger | 404/42 |
| 4,616,959 | 10/1986 | Hilfiker . | |
| 4,627,767 | 12/1986 | Field et al. | 405/208 X |
| 4,640,071 | 2/1987 | Haener | 52/286 |
| 4,651,485 | 3/1987 | Osborne | 52/284 |
| 4,658,541 | 4/1987 | Haile | 47/83 |
| 4,659,304 | 4/1987 | Day . | |
| 4,660,342 | 4/1987 | Salisbury | 52/358 |
| 4,661,023 | 4/1987 | Hilfiker . | |
| 4,671,706 | 6/1987 | Giardini | 405/286 |
| 4,684,294 | 8/1987 | O'Neill . | |
| 4,698,949 | 10/1987 | Dietrich . | |
| 4,711,606 | 12/1987 | Leling et al. | 405/286 |
| 4,721,847 | 1/1988 | Leverenz . | |
| 4,726,567 | 2/1988 | Greenberg | 256/19 |
| 4,728,227 | 3/1988 | Wilson et al. . | |
| 4,738,059 | 4/1988 | Dean, Jr. . | |
| 4,770,218 | 9/1988 | Duerr . | |
| 4,784,821 | 11/1988 | Leopold | 264/510 |
| 4,802,320 | 2/1989 | Forsberg | 52/585 |
| 4,802,836 | 2/1989 | Whissell | 425/253 |
| 4,815,897 | 3/1989 | Risi et al. | 405/284 |
| 4,824,293 | 4/1989 | Brown et al. . | |
| 4,825,619 | 5/1989 | Forsberg | 52/562 |
| 4,860,505 | 8/1989 | Bender | 52/98 |
| 4,884,921 | 12/1989 | Smith . | |
| 4,896,472 | 1/1990 | Hunt . | |
| 4,896,999 | 1/1990 | Ruckstuhl | 405/286 |
| 4,909,010 | 3/1990 | Gravier . | |
| 4,909,717 | 3/1990 | Pardo | 425/138 |
| 4,914,876 | 4/1990 | Forsberg . | |
| 4,936,712 | 6/1990 | Glickman . | |
| 4,964,761 | 10/1990 | Rossi . | |
| 4,965,979 | 10/1990 | Larrivee et al. . | |
| 5,017,049 | 5/1991 | Sievert | 405/286 X |
| 5,031,376 | 7/1991 | Bender et al. | 52/609 |
| 5,044,834 | 9/1991 | Janopaul, Jr. | 405/284 |
| 5,062,610 | 11/1991 | Woolford et al. | 249/52 |
| 5,104,594 | 4/1992 | Hillemeier et al. . | |
| 5,125,815 | 6/1992 | Kargarzadeh et al. . | |
| 5,139,721 | 8/1992 | Castonguay et al. . | |
| 5,158,132 | 10/1992 | Guillemot | 165/30 |
| 5,161,918 | 11/1992 | Hodel . | |
| 5,261,806 | 11/1993 | Pleasant . | |
| 5,294,216 | 3/1994 | Sievert . | |

FOREIGN PATENT DOCUMENTS

| | | |
|---|---|---|
| 531354 | 10/1958 | Canada . |
| 941626 | 2/1974 | Canada . |
| 1040452 | 10/1978 | Canada . |
| 1065154 | 10/1979 | Canada . |
| D. 47747 | 1/1981 | Canada . |
| D. 51160 | 4/1983 | Canada . |
| D. 51313 | 5/1983 | Canada . |
| D. 51794 | 9/1983 | Canada . |
| 1182295 | 2/1985 | Canada . |
| 1188116 | 6/1985 | Canada . |
| 1194703 | 10/1985 | Canada . |
| 1197391 | 12/1985 | Canada . |
| 1204296 | 5/1986 | Canada . |
| 62875 | 4/1989 | Canada . |
| D. 62875 | 4/1989 | Canada . |
| D. 63365 | 5/1989 | Canada . |
| D. 63366 | 5/1989 | Canada . |
| D. 65896 | 4/1990 | Canada . |
| D. 66760 | 8/1990 | Canada . |
| D. 67904 | 1/1991 | Canada . |
| 2012286 | 9/1991 | Canada . |
| 0170113 A1 | of 0000 | European Pat. Off. . |
| 0 039 372 | 11/1981 | European Pat. Off. . |
| 0 130 921 | 1/1985 | European Pat. Off. . |
| 0 170 113 | 7/1985 | European Pat. Off. . |
| 0 215 991 | 9/1985 | European Pat. Off. . |
| 0 322 668 | 12/1988 | European Pat. Off. . |
| 0 362 110 | 4/1990 | European Pat. Off. . |
| 392474 | 11/1908 | France . |
| 1360872 | 4/1963 | France . |
| 2228900 | 5/1974 | France . |
| 2 243 304 | 9/1974 | France . |
| 2 343 871 | 5/1976 | France . |
| 2 409 351 | 11/1977 | France . |
| 2 422 780 | 12/1978 | France . |
| 2 463 237 | 8/1979 | France . |
| 2 465 032 | 9/1979 | France . |
| 2 476 179 | 2/1980 | France . |
| 12 561 684 | 3/1984 | France . |
| 2561684 | 9/1985 | France . |
| 0 215 991 | 1/1987 | France . |
| 1604-40091 | 4/1987 | France . |
| 2622227 | 4/1989 | France . |
| 2 622 227 | 12/1989 | France . |
| 0 362 110 | 4/1990 | France . |
| 3401629 A1 | of 0000 | Germany . |
| 22 59 654 | 6/1974 | Germany . |
| 18 11 932 | 6/1978 | Germany . |
| 27 55 833 | 7/1978 | Germany . |
| E 02 D 29/02 | 9/1978 | Germany . |
| 27 19 107 | 11/1978 | Germany . |
| 657 172 A5 | 12/1978 | Germany . |
| 28 41 001 | of 1980 | Germany . |
| 34 01 629 | 7/1984 | Germany . |
| E02D 23/02E | 5/1990 | Germany . |
| 456776 | 4/1950 | Italy . |
| 459942 | 10/1950 | Italy . |
| 709599 | 6/1966 | Italy . |
| 92167 | 7/1948 | New Zealand . |
| 151299 | 4/1969 | New Zealand . |
| 218330 | 9/1989 | New Zealand . |
| 24781 | 5/1993 | New Zealand . |
| 25131 | 6/1994 | New Zealand . |
| 25132 | 6/1994 | New Zealand . |
| 25133 | 6/1994 | New Zealand . |
| 27313 | 6/1996 | New Zealand . |
| 27314 | 6/1996 | New Zealand . |
| 27315 | 6/1996 | New Zealand . |
| 27316 | 6/1996 | New Zealand . |
| 27317 | 6/1996 | New Zealand . |
| 27318 | 6/1996 | New Zealand . |
| 27346 | 9/1996 | New Zealand . |
| 27675 | 9/1996 | New Zealand . |
| 27676 | 9/1996 | New Zealand . |
| 27677 | 9/1996 | New Zealand . |
| 657172 A5 | of 0000 | Switzerland . |
| 205452 | 9/1939 | Switzerland . |
| 47747 | 1/1981 | Switzerland . |
| 657 172 | 8/1986 | Switzerland . |
| 657172 A5 | 8/1986 | Switzerland . |
| 663437 A5 | 12/1987 | Switzerland . |
| 669 001 | 2/1989 | Switzerland . |
| 970595 | 1/1963 | U.S. . |
| 215196 | 12/1989 | U.S. . |
| 678160 | of 0000 | U.S.S.R. . |
| 678160 | 12/1977 | U.S.S.R. . |
| 1145106 A | 5/1982 | U.S.S.R. . |
| 1145106 A | of 1985 | U.S.S.R. . |

| | | | |
|---|---|---|---|
| 1768701 | 10/1992 | U.S.S.R. | 405/205 |
| 1500005 A1 | 11/1992 | U.S.S.R. . | |
| 536434 | of 0000 | United Kingdom . | |
| 336 | 2/1871 | United Kingdom . | |
| 107338 | 12/1916 | United Kingdom . | |
| 154397 | 10/1919 | United Kingdom . | |
| 154397 | of 1920 | United Kingdom . | |
| 537153 | 6/1941 | United Kingdom . | |
| 1 385 207 | 1/1975 | United Kingdom . | |
| 1 386 088 | 3/1975 | United Kingdom . | |
| 1 477 139 | 6/1977 | United Kingdom . | |
| 2 091 775 | 8/1982 | United Kingdom . | |
| 2 127 872 | 4/1984 | United Kingdom . | |
| 2 213 095 | 8/1989 | United Kingdom . | |
| 0 490 534 A2 | 11/1991 | United Kingdom . | |

OTHER PUBLICATIONS letter, Jul. 18, 1990, William R. Baach to Lonn Hanson of Minn Key.
excerpts from deposition testimony of Paul J. Forsberg.
excerpts from deposition testimony of Robert McDonald.
I.K. Nanazashvily, Stroitelnyie materialyl iz drevesno–cementnoy6 kompozitsii.L., stroyizdat, Leningradskoe otdelenie, 1990, pp. 334–335, fig. 11.2.
Turin, Universal Concrete Masonry or Precast Garden Unit, 1972 2 pp.
Author Unknown, Mortarless Perpend Keyed Jointed Block, 1978 2 pp., and Stepped Retaining Wall Units with Rear Downset Leg Produced on Besser Machines.
Bill Blaha, Retaining Wall System Keyed to Success, date unknown, 3 pp.
Advanced concrete technology Features New Design, Mar. 1989, 2 pp.
"Instructions Little Might 550", Permacrib (date unknown).
"The easy, economical Crib System Wall . . . ", Monier Masonry (date unknown).
"Besser—Crib Wall", (date unknown).
"Color Crib Wall", Brik Blok Industries (date unknown).
"Concrib", Cavitex Concrete Masonry Ltd. (date unknown).
"Lo–Crib", Rocla (date unknown).
"Cribwallining—techniques and design considerations", N.Z. Portland Cement Assoc. (Apr., 1970).
"Pinned Cribbing", Rocla (date unknown).
"V–Blocks", Humes, Ltd. (date unknown).
"Mini–Type Crib Walls", Humes, Ltd. (date unknown).
"Minicrib Retaining Walls", Humes, Ltd. (date unknown).
"Information for the Planting and Mintenance of Crib Wall Vegetation", Humes, Ltd. (date unknown).
"Pisa II, Dura–Hold, Dura–Crib", Risi Stone, Ltd. (date unknown).
"TubaWall", Tubag (date unknown).
"Heinzmann Green Wall System", gebr. Heinzmann (date unknown).
"Uni–Multiwall", F. von Langsdorff—Buverfahren GmbH (date unknown).
"Florakron System", Kronimus Betonsteinwerke (date unknown).
"Terrace Block", Besser (Qld.), Ltd. (date unknown).
"Eskoo–kleine Kreuzwand", SF Kooperation gmbh (date unknown).
"Slope and Road Paving Block", Columbia Machine, Inc. (circa 1970–75).
"Erosion control system produced on a block machine", D. Gehring (date unknown).
"Articulated Revetment Units", author and date unknown).
"Columbia Retaining Wall Block", Columbia Machine, Inc. (date unknown).
"Soil Stabilisation and Erosion Control Systems", Winstons (Jul. 1974).
"Unibank Creative Embankment", Rocla Masonry (May 1995).
"Beautify Your Landscape", Block Systems, Inc. (Aug. 1990).
"New Mortarless Block Retaining Wall System", Concrete Products (Mar. 1989).
"Jewell Concrete Products, Inc. Expands to New Markets", Besser Block (Fall 1988).
"Strabenbau heute", (author and date unknown).
"SF Kooperation", SF–Vollverbundstein–Kooperation GmbH (date unknown).
"Australian Concrete Technology", p. 296 (author and date unknown).
"Landscape Architecture", p. 99 (Aug. 1989).
"Landscape Architecture", p. 101 (Dec. 1989).
"Landscape Architecture", p. 103 (Apr. 1993).
Robert L. Hubler, Jr., Single–element retaining wall systems is ideal for block producers, Sep., 1983, 30, 33.
Author unknown, Besser Parts & Equipment Catalog, date unknown, 1–80.
T.K. Nanazashvily, Stroitelnye materialy is drevesho—cementhoy kampozitsii, 1990, 334–335, 1–7.
Author unknown, Profile Hex Masonry Units, date unknown, 2 pp.
Lucas E. Pfeiffenberger, Besser Technical Data for The Blockmaker, Fall, 1982, 4 pp.
Lucas E. Pfeiffenberger, High Quality Pavers From a Besser V3–12 Block Machine.
Author unknown, Florida block and r/m plant relies on admixtures, date unknown, 1 p.
Author unknown, Diamond Wall System Installation Guide, 1989, 2 pp.
Author unknown, title unknown, 1989, 1 p.
Author unknown, Besser Concrete Paving Stones, date unknown, Section 5, 1–24.
Retaining Wall Block Pictures (date unknown).
Columbia Machine Mold Decriptions (date unknown).
Kawano Cement Brochure (date unknown).
*Diamond Block* Test Report to University of Wisconsin, Platteville (1990).
*Versa Lock* Product Literature (date unknown).
*Johnson Block* Product Literature (date unknown).
Orco Block Co. *Split Face Block* Product Literature (date unknown).
*Handy–Stone Retaining Wall System* Product Literature (date unkown).
*Aztech Wall System* Installation Guide, Block Systems, Inc. (1989).
*EZ Wall Systems* Product Literature, Rockwood Retaining Wall Systems, Inc. (date unknown).
*Windsor Stone* Product Literature, Block Systems, Inc. (1991).
*Diamond Wall Systems: The Cutting Edge*, Anchor Block Co. (date unknown).
Various Diamond Wall System 4 and 4.4 Concrete Masonry Units Tech Spec.'s, Anchor Block (1988, 1989).
*Modular Concrete Block*, the Besser Co. (date unknown).
*Paving Stone: New Look With Old World Charm*, the Besser Co. (date unknown).

*Keystone International Compac Unit* product literature (1992).
*Keystone Retaining Wall Systems* Product Literature (1992).
*Garden Wall* Product Literature (1991).
Standard Load Bearing Wall Tile Literature (1924).
Anchor Autoclave Product Literature (1990).
Catalog sheet "The Allan Block Advantage" (date unknown).
"The Allan Block Advantage" (date unknown).
"Ivany Block" Retaining Walls (date unknown).
"The Estate Wall by Unilock", Unilock Chicago, Inc. (date unknown).
"Pisa II" Interlocking Retaining Wall Supplies for Garden Landscaping (date unknown).
Weiser Concrete, Inc., Weiser Slope Blocks Advertisement (date unknown).

COMPOSITE MASONRY BLOCK

This is a File Wrapper Continuation of application Ser. No. 08/675,572, filed Jul. 3, 1996, which is a Continuation of application Ser. No. 08/469,795, filed Jun. 6, 1995, now U.S. Pat. No. 5,589,124, which is a Continuation of application Ser. No. 08/157,830, filed Nov. 24, 1993, which is a Divisional of application Ser. No. 07/651,322, filed Feb. 6, 1991, now U.S. Pat. No. 5,294,216, which is a Divisional of application Ser. No. 07/534,831, filed Jun. 7, 1990, now U.S. Pat. No. 5,062,610, which is a Continuation-In-Part of application Ser. No. 07/413,400, filed Sep. 27, 1989, which is a Continuation-In-Part of application Ser. No. 07/413,050, filed Sep. 27, 1989, now abandoned.

FIELD OF THE INVENTION

This invention relates generally to masonry blocks which may be used in the construction of landscaping elements. More specifically, the present invention relates to masonry block manufacturing processes and the resulting high strength masonry blocks which may be used to construct structures such as retaining walls of variable patterns.

BACKGROUND OF THE INVENTION

Soil retention, protection of natural and artificial structures, and increased land use are only a few reasons which motivate the use of landscape structures. For example, soil is often preserved on a hillside by maintaining the foliage across that plane. Root systems from trees, shrubs, grass, and other naturally occurring plant life work to hold the soil in place against the forces of wind and water. However, when reliance on natural mechanisms is not possible or practical man often resorts to the use of artificial mechanisms such as retaining walls.

In constructing retaining walls many different materials may be used depending upon the given application. If a retaining wall is intended to be used to support the construction of an interstate roadway, steel or a concrete and steel retaining wall may be appropriate. However, if the retaining wall is intended to landscape and conserve soil around a residential or commercial structure a material may be used which compliments the architectural style of the structure such as wood timbers or concrete block.

Of all these materials, concrete block has received wide and popular acceptance for use in the construction of retaining walls and the like. Blocks used for these purposes include those disclosed by Risi et al, U.S. Pat. Nos. 4,490,075 and Des. 280,024 and Forsberg, U.S. Pat. Nos. 4,802,320 and Des. 296,007 among others. Blocks have also been patterned and weighted so that they may be used to construct a wall which will stabilize the landscape by the shear weight of the blocks. These systems are often designed to "setback" at an angle to counter the pressure of the soil behind the wall. Setback is generally considered the distance which one course of a wall extends beyond the front of the next highest course of the same wall. Given blocks of the same proportion, setback may also be regarded as the distance which the back surface of a higher course of blocks extends backwards in relation to the back surface of the lower wall courses. In vertical structures such as retaining walls, stability is dependent upon the setback between courses and the weight of the blocks.

For example, Schmitt, U.S. Pat. No. 2,313,363 discloses a retaining wall block having a tongue or lip which secures the block in place and provides a certain amount of setback from one course to the next. The thickness of the Schmitt tongue or lip at the plane of the lower surface of the block determines the setback of the blocks. However, smaller blocks have to be made with smaller tongues or flanges in order to avoid compromising the structural integrity of the wall with excessive setback. Manufacturing smaller blocks having smaller tongues using conventional techniques results in a block tongue or lip having inadequate structural integrity. Concurrently, reducing the size of the tongue or flange with prior processes may weaken and compromise this element of the block, the course, or even the entire wall.

Previously, block molds were used which required that the block elements such as a flange be formed from block mix or fill which was forced through the cavity of the mold into certain patterned voids within the press stamp or mold. The patterned voids ultimately become the external features of the block body. These processes relied on the even flow of a highly viscous and abrasive fill throughout the mold, while also not allowing for under-filling of the mold, air pockets in the fill or the mold, or any other inaccuracies which often occur in block processing.

The result was often that a block was produced having a well compressed, strong block body having weak exterior features. Any features formed on the block were substantially weaker due to the lack of uniform pressure applied to all elements of the block during formation. In turn, weaker exterior features on the outside of the block such as an interlocking flange could compromise the entire utility of the block if they crumble or otherwise deteriorate due to improper formation.

The current design of pinless, mortarless masonry blocks generally also fails to resolve other problems such as the ability to construct walls which follow the natural contour of the landscape in a radial or serpentine pattern. Previous blocks also have failed to provide a system allowing the use of anchoring mechanisms which may be affixed to the blocks without complex pinning or strapping fixtures. Besides being complex, these pin systems often rely on only one strand or section of a support tether which, if broken, may completely compromise the structural integrity of the wall. Reliance on such complex fixtures often discourages the use of retaining wall systems by the every day homeowner. Commercial landscapers generally avoid complex retaining wall systems as the time and expense involved in constructing these systems is not supportable given the price at which landscaping services are sold.

As can be seen the present state of the art of forming masonry blocks as well as the design and use of these blocks to build structure has definite shortcomings.

SUMMARY OF THE INVENTION

In accordance with the present-invention there is provided a composite masonry block comprising a block body having a front surface and a substantially parallel back surface, an upper surface and a lower surface, and first and second sidewall surfaces each comprising a first and second part. The sidewall first part extends from the block front surface towards the block back surface at an angle of no greater than ninety degrees in relationship to the block front surface. The sidewall second part adjoins and lies between the sidewall first part and the block back surface. The block of the present invention also comprises a flange extending from the block back surface past the height of the block.

In accordance with a further aspect of the present invention there are provided landscaping structures such as retaining walls comprising a plurality of courses, each of the courses comprising a plurality of the composite masonry blocks of the present invention.

In accordance with an additional aspect of the present invention there is provided a masonry block mold, the mold comprising two opposing sides and a front and back wall. The opposing sides adjoin each other through mutual connection with the mold front and back walls. The mold has a central cavity bordered by the mold opposing sides and the mold front and back wall. The mold opposing sides comprise stepped means for holding additional block mix in the mold cavity adjacent the front and back walls.

In accordance with another aspect of the present invention there is provided a method of using the composite masonry block mold of the present invention comprising filling the mold, subjecting the fill to pressure, and ejecting the formed masonry blocks from the mold.

DETAILED DESCRIPTION OF THE PREFERRED EMBODIMENTS

Figure 1:
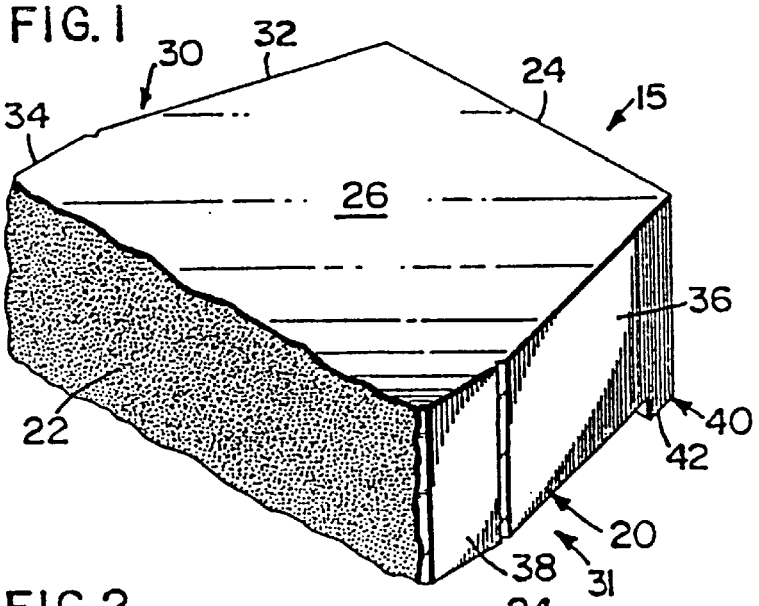
FIG. 1 is a perspective view of a preferred embodiment of the mortarless retaining wall block in accordance with the present invention.

Accordingly, the present invention provides a composite masonry block, structures resulting from this block, a masonry block mold for use in manufacturing the block of the present invention, and a method of using this mold. The present invention provides a mortarless interlocking masonry block having a high structural integrity which may be used to construct any number of structures having a variety of patterns. Moreover, the block of the present invention is made through a process and mold which facilitates and enhances the formation of a high strength block with an interlocking element which also has a high structural integrity and allows the fabrication of various landscaping structures of high strength.

Composite Masonry Block

Referring to the drawings wherein like numerals represent like parts throughout several views, a composite masonry block 15 is generally shown in FIGS. 1–3 and 4–6. The first aspect of the present invention is a composite masonry block having an irregular trapezoidal shaped block body 20.

The block body generally comprises a front surface 22 and a back surface 24 which are substantially parallel to each other. The front 22 and back 24 surfaces are separated by a distance comprising the depth of the block. The block also has an upper surface 26 and a lower surface 28 separated by a distance comprising the height of the block 15. The lower surface 28 generally has a smaller area proportion than the upper surface 26, FIG. 3.

Figure 2:
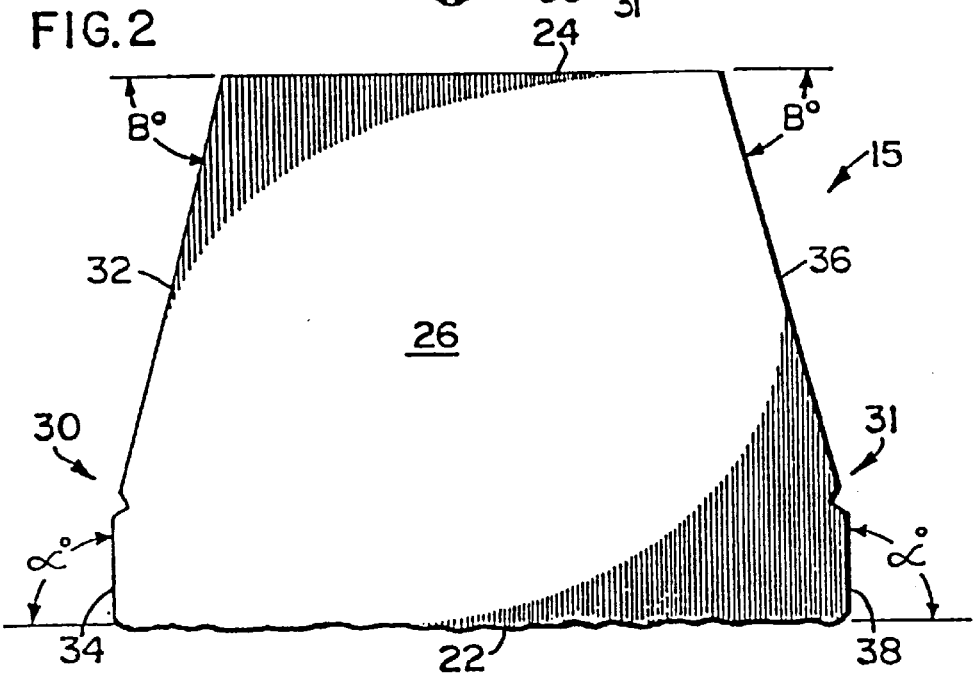
FIG. 2 is a top plan view of the mortarless retaining wall block shown in FIG. 1.
Figure 5:
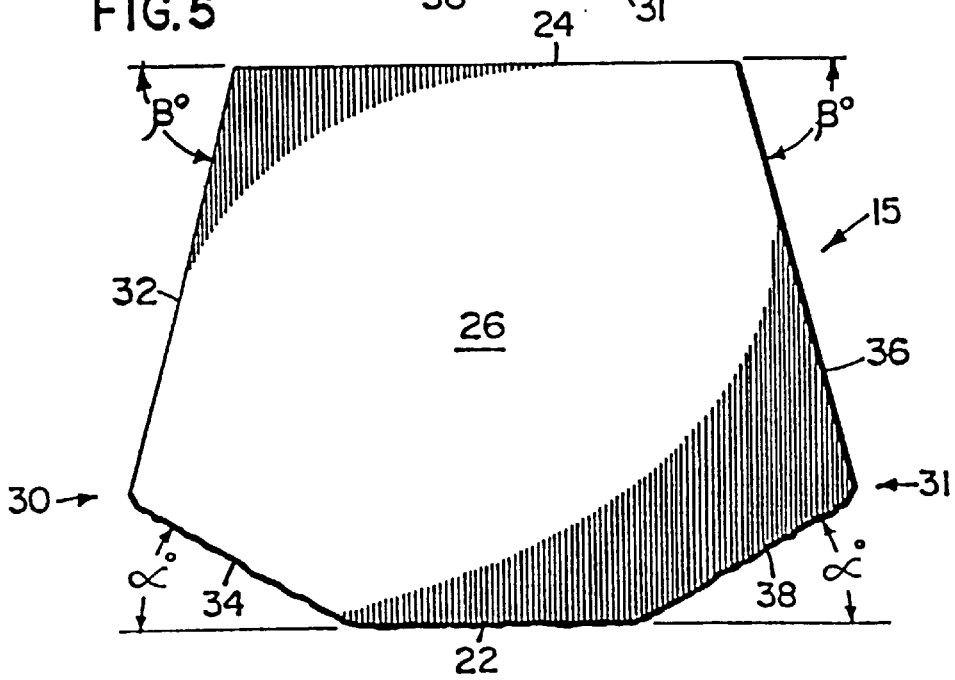
FIG. 5 is a top plan view of the mortarless retaining wall block depicted in FIG. 4.

The block also has a first 30 and second 31 sidewall separated by a distance comprising the width of the block, FIGS. 2 and 5. The sidewalls adjoin the block upper and lower surfaces. Both sidewalls comprise a first and second part. The sidewall first part extend from the block front surface towards the back surface at an angle of no greater than ninety degrees in relationship to the block front surface. The sidewall second part adjoins and lies between the first part and the block back surface.

Figure 3:
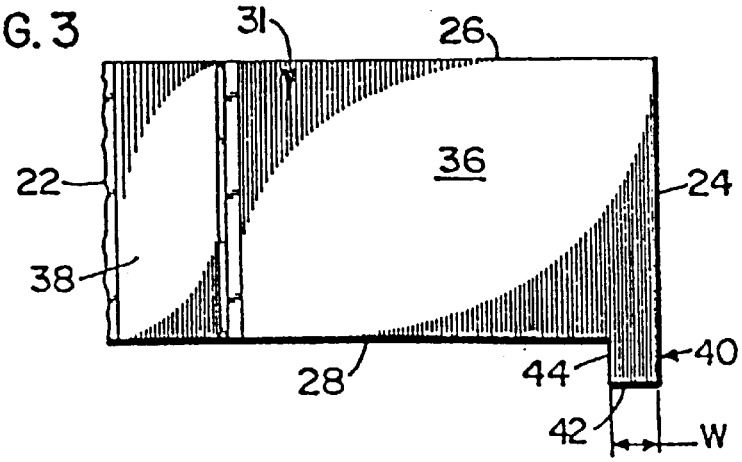
FIG. 3 is a side elevational view of a mortarless retaining wall block shown in FIG. 1.
Figure 6:
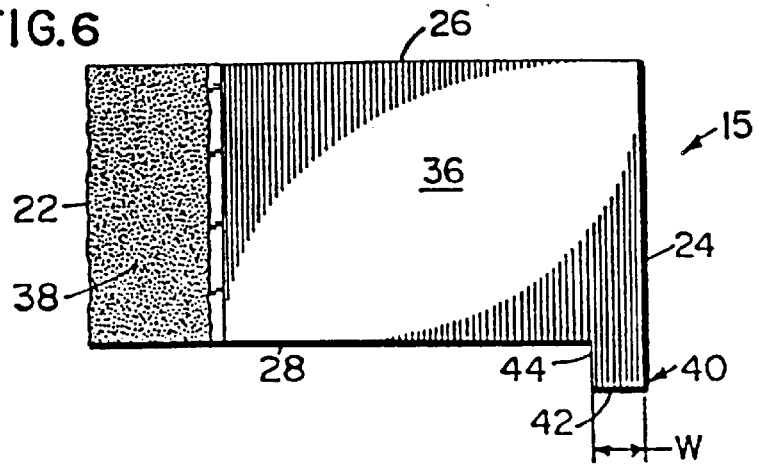
FIG. 6 is a side elevational view of the mortarless retaining wall block depicted in FIGS. 4 and 5.

The block also has a flange 40 spanning the width of the block back surface 24 and extending from the block back surface 24 past the height of the block, FIGS. 3 and 6. Generally, the flange comprises a setback surface 42 and a locking surface 44. The setback surface 42 extends from the lower edge of the flange 40 in a plane parallel to the block upper 26 and lower 28 surfaces towards the block front surface 22 to adjoin the flange locking surface 44. The locking surface extends from the plane of the block lower surface 28 and adjoins the setback surface 42.

The first element of the composite masonry block of the present invention is the body of the block 20, FIGS. 1–3. The block body 20 provides weight and physical structure to the system in which the block is used. Landscaping elements such as retaining walls often must be constructed of units which not only provide a structural impediment to resist the natural flow of soil, but must also provide the shear weight to withstand these forces. Moreover, the body of the block functions to provide the supporting surfaces which may be used to seat an aesthetically pleasing pattern such as that found on the front surface 22 of the block, FIG. 1. Finally the body of the block of the present invention provides a substrate for holding elements which help form an interlocking matrix with other blocks when used in a structure such as a wall. In particular, the block carries a flange 40 which assists in the interlocking function of the block.

Generally, the block may take any number of shapes in accordance with the present invention. Distinctive of the present invention is the ability to use the block seen in FIGS. 1–3 and 4–6 to construct either straight or serpentine walls. Accordingly, the block of the present invention preferably has an irregular trapezoidal shape having a parallel front 22 and back surfaces 24, FIG. 2. The necessarily irregular nature of the trapezoidal block of the present invention comes from the blocks two part sidewalls 30, 31, FIG. 2.

As can be seen, the block body 20 generally has eight surfaces. The front surface 22 generally faces outward from the structure and may either have a plain or a roughened appearance to enhance the blocks aesthetic appeal. In fact, the block front surface 22 may be smooth, rough, planar or nonplanar, single faceted or multi-faceted.

The back surface 24 of the block generally lies parallel to the front surface 22. The top surface 26 generally lies parallel to the bottom surface 28. As can be seen, FIG. 3, the upper surface has a greater depth across the block than the lower surface 28. Generally, the difference in depth between the upper surface 26 and the block lower surface 28 is attributable to the position of the flange 40, extending in part from the lower surface of the block, FIG. 3.

The block body sidewall surfaces 30, 31 lie across the width of the block, FIG. 2. The sidewalls of the block body of the present invention allow for the construction of straight structures or serpentine structures and more particularly outside radius turns. Accordingly, the block sidewalls are preferably of two-part construction. As can be seen in FIG. 2, the block sidewall first parts 34, 38 extend on either side of the block from the block front surface at an angle, alpha, of approximately ninety degrees toward the block back surface, FIG. 2.

Generally, at about one-fifth to about one-quarter of the depth of the block, the sidewall first part 38 joins the sidewall second part, FIGS. 2 and 3. The sidewall second part 32, 36 generally continue further towards the back surface 24 of the block body. Preferably, the sidewall second surfaces converge towards each other as these surfaces move towards the back surface of the block. The angle, beta, of the sidewall second preferably ranges in magnitude from about 30 degrees to about 60 degrees in relation to the block back surface, FIG. 2. This provides structures having a more aesthetically preferable or pleasing appearance by avoiding a "stepped" appearance which results from the adjacent placement of blocks having an extreme sidewall angle.

Figure 7:
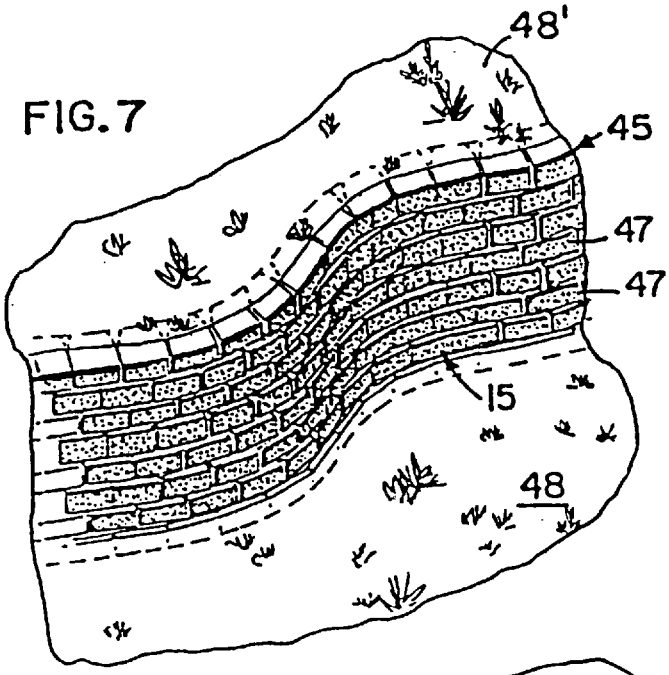
FIG. 7 is a partially cut away perspective view of a retaining wall having a serpentine pattern constructed with one embodiment of the composite masonry block of the present invention.
Figure 8:
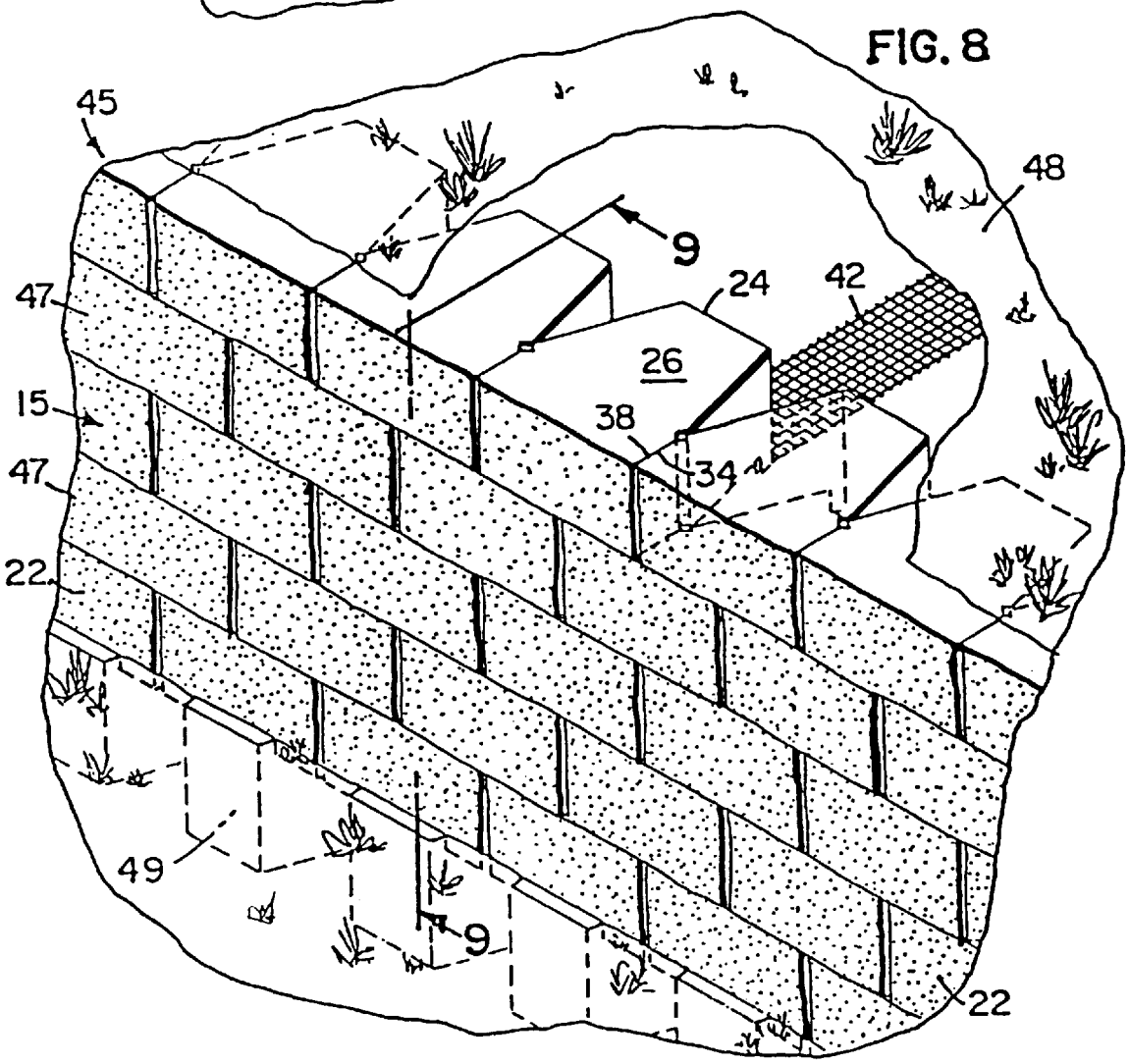
FIG. 8 is a partially cut away perspective view of a retaining wall constructed with one embodiment of the composite masonry block of the present invention showing use of the block with anchoring matrices laid into the ground.

The two-part sidewalls allow for the construction of aligned, straight walls given the sidewall first part which aligns with adjoining sidewall first parts of blocks in the same wall course, (see 34, 38, FIG. 8). Optionally, the same embodiment of the block of the present invention allows the construction of aligned serpentine structure 45, FIG. 7.

Figure 4:
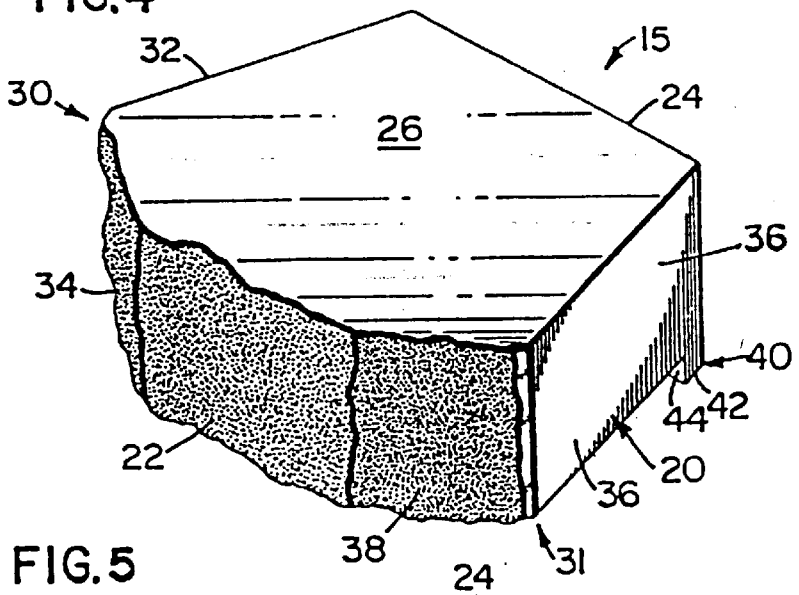
FIG. 4 is a perspective view of an alternative embodiment of the mortarless retaining wall block in accordance with the present invention.

Alternatively, the first part of the sidewall surfaces may have an angle, alpha, which is less than ninety degrees, FIGS. 4–6. This embodiment of the block of the present invention may more preferably be used in the construction of serpentine structures such as that shown in FIG. 7. In this instance, the block sidewall first part provides a block with a more aesthetically refined, rounded or multi-faceted front surface 22, FIG. 4. The sidewall second part in this embodiment of the block of the present invention also converge along angle, beta, towards the rear surface of the block allowing the construction of a structure similar to that shown in FIG. 7.

The block of the present invention also comprises a flange 40, FIGS. 3 and.6. The flange 40 assists in providing an effective interlocking mechanism which stabilizes the structures made in accordance with the present invention. Moreover, the block mold and method of molding blocks of the present invention allow the formation of block elements, such as flange 40, having high structural strength. The processing simultaneously affords the construction of interlocking elements having minimal size. The result of flanges having such minimal size is a structure having minimal setback and maximum stability given the weight and proportions of the blocks used.

The flange 40 may take any number of forms. Preferably, the flange 40 spans the width the blocks back surface 24 and extends from the block back surface beyond the height of the block. Generally, the flange 40 will extend beneath the lower surface of the block so that when stacked the flange 40 of each ascending block will hang over and lock onto the back surface of the block of the adjacent block in the next lowest course, FIG. 9.

The flange 40 may comprise any number of surfaces to aid in seating and locking the block in place. Preferably, the flange has a setback surface 42 and a locking surface 44. The setback surface generally adjoins and extends from the lower edge of the flange in a plane parallel to the block upper and lower surfaces. Adjoining the flange setback surface 42 and the block lower surface 28 is the flange locking surface 44, FIGS. 3 and 6.

The width of the setback surface determines the amount that the blocks of each successive course will setback from blocks from the next lower course. Generally, each successive course of blocks should setback far enough to maintain the stability of the soil behind the wall. In turn, flange 40 generally should be large enough to provide a high strength interlocking element, while remaining small enough to retain the stability of the wall. To this end, the width W of the setback surface 42, FIGS. 3 and 6, generally ranges in width from about 1 inch to about 2 inches across its base. This width range provides minimal setback while ensuring the provision of a strong flange.

In its most preferred mode, the block of the present invention is suitable for both commercial and residential use by landscapers as well as homeowners for use in building landscape structures. In this instance, the block generally weighs from about 50 lbs. to about 100 lbs. and more preferably 65 lbs. to 75 lbs. and has a height of about 3 inches to 12 inches, and more preferably 3 inches to 6 inches, a width of about 12 inches to about 18 inches, and more preferably 14 inches to 16 inches, and a length of about 6 inches to about 24 inches and more preferably 14 inches to about 16 inches. These measurements allow the maintenance of the appropriate weight to width ratio of the block, provide a block weighted to allow manual transport by one person, and ensures optimal efficiency in the use of machinery.

Block Structures

Figure 9:
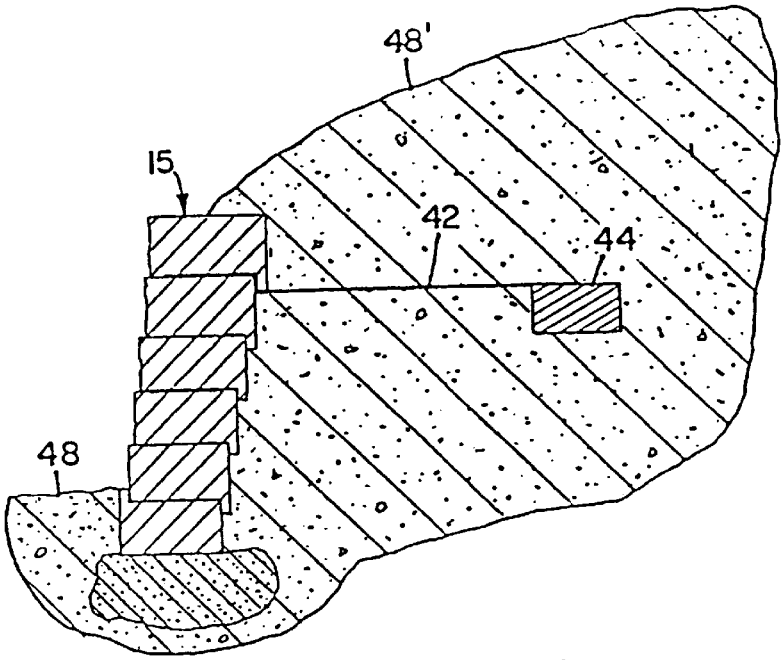
FIG. 9 is a cut away view of the wall shown in FIG. 8 taken along lines 9—9.

The composite masonry block 15 of the present invention may be used to build any number of landscape structures. Examples of the structures which may be constructed with the block of the present invention are seen in FIGS. 7–9. As can be seen in FIG. 7, the composite masonry block of the present invention may be used to build a retaining wall 45 using individual courses 47 to construct to any desired height. The blocks may be stacked in an even pattern or an offset pattern depending on the intended application.

Generally, construction of a structure such as a retaining wall 45 may be undertaken by first defining a trench area beneath the plane of the ground 48 in which to deposit the first course 49 of blocks, FIGS. 7 and 8. Once defined, the trench is partially refilled and tamped or flattened. The first course 49 of blocks is then laid into the trench, FIG. 8. The first course of blocks may often comprise blocks which are laid on their back in order to define a pattern or stop at the base of the wall. As can be seen in FIGS. 7–9, successive courses of blocks are then stacked on top of preceding courses while backfilling the wall with soil 48'. As stability is dependent upon weight and minimal setback, the minimal setback provided by the blocks of the present invention assists in further stabilizing even lighter weight blocks. This minimal setback adds to the stability of smaller size blocks by slowing the horizontal movement backward of the wall through the addition of successive courses.

As can be seen in FIGS. 7 and 8 the blocks of the present invention allow for the production of serpentine or straight walls. The blocks may be placed at an angle in relationship to one another so as to provide a serpentine pattern having convex and concave surfaces, FIG. 7. Moreover, depending on which embodiment of the block of the present invention is used, various patterns, serpentine or straight, may be produced in any given structure.

One benefit of the blocks of the present invention is their two part sidewall. While the first part of the side wall has a right angle in relationship to the front surface of the block 22, the second part of the block sidewalls converge or angle towards each other as the sidewall moves towards the back surface 24 of the block. The converging second part of the block sidewalls allows the blocks to be set in a range of angles relative to adjacent blocks of the same course, FIG. 7.

Moreover, when a straight wall is desired, FIG. 8, the blocks of the present invention allow for the placement of the blocks flush against each other. As can be seen in FIG. 8, block sidewall first part surfaces 38 and 34 of two adjacent blocks are flush against one another. This allows for the construction of a wall having tighter block placement.

In contrast, if a more highly angled serpentine wall is desired the block depicted in FIGS. 4–6 may be used. This block comprises sidewall first parts 34, 38 which have an angle and which may be less than 90°. As can be seen, the sidewalls first part 34, 38 effectively become the second and third faces along with the block front surface 22, of a three faceted front of the block. The lack of a 90° sidewall first part shortens the effective length of the block depicted in FIGS. 4–6. Thus, in angling the blocks of FIGS. 4–6 the length of the sidewalls first part 34, 38 does not become a factor block placement. As a result blocks of the same relative size and weight may be used more efficiently given limited space.

As can be seen in FIG. 8, a supporting matrix 42 may be used to anchor the blocks in the earth fill 48' behind the wall. One advantage of the block of the present invention is that despite the absence of pins, the distortion created by the block flange 40 anchors the entire width of the matrix 42 when pressed between two adjacent blocks of different courses, FIG. 9.

In this instance, a wall is constructed again by forming a trench in the earth. The first course 49 of the wall is seated in the trench and will be under soil once the wall is backfilled. The blocks 15 are placed on a securing mat or matrix 42 which is secured within the bank 48' by deadheads 44. The deadheads 44 serve as an additional stabilizing factor for the wall providing additional strength. The deadheads 44 may be staggered at given intervals over the length of each course and from course to course to provide an overall stability to the entire wall structure.

Block Molding the Blocks

An additional aspect of the present invention is the process for casting or forming the composite masonry blocks of this invention using a masonry block mold. Generally, the process for making this invention includes block molding the composite masonry block by filling a block mold with mix and casting the block by compressing the mix in the mold through the application of pressure to the exposed mix at the open upper end of the block mold. Formation of the block of the present invention is undertaken with a stepped mold to ensure that the pressure applied to the entire block 15 is uniform across the body 20 and flange 40.

Figure 10:
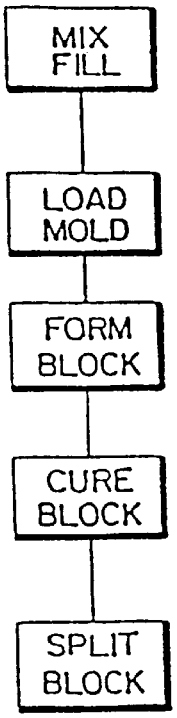
FIG. 10 is a schematic depiction of one embodiment of the method of the present invention.

An outline of the process can be seen in the flow chart shown in FIG. 10. Generally, the processes is initiated by mixing the concrete fill. Any variety of concrete mixtures may be used with this invention depending upon the strength, water absorption, density, and shrinkage among other factors desired for the given concrete block. One mixture which has been found to be preferable includes cementations materials such as cement or fly ash, water, sand, and gravel or rock. However, other components including plasticizers, water proofing agents, cross-linking agents, dyes, colorants, pigments etc. may be added to the mix in concentrations up to 5 wt-% depending upon the physical characteristics which are desired in the resulting block.

Blocks may be designed around any number of different physical properties in accordance with ASTM Standards depending upon the ultimate application for the block. For example, the fill may comprise from 75 to 95% aggregate being sand and gravel in varying ratios depending upon the physical characteristics which the finished block is intended to exhibit. The fill generally also comprises some type of cementatious materials at a concentration ranging from 4% to 12%. Other constituents may then be added to the fill at various trace levels in order to provide blocks having the intended physical characteristics.

Generally, once determined, the fill constituents may be placed in any number of general mixers including those commonly used by those with skill in the art for mixing cement and concrete. To mix the fill, the aggregate, the sand and rock, is first dumped into the mixer followed by the cement. After one to two and one-half minutes, any plasticizers that will be used are added. Water is then introduced into the fill in pulses over a one to two minute period. The concentration of water in the mix may be monitored electrically by noting the resistance of the mix at various times during the process. While the amount of water may vary from one fill formulation to another fill formulation, it generally ranges from about 1% to about 6%.

Figure 11:
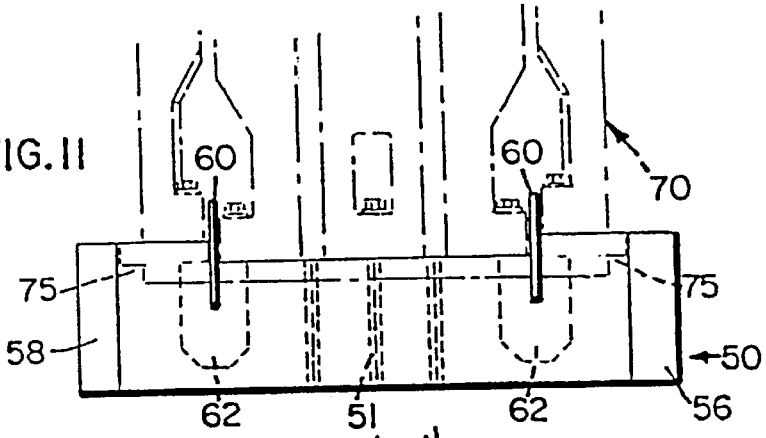
FIG. 11 is a side elevational view of one embodiment of the masonry block mold in accordance with the present invention.
Figure 12:
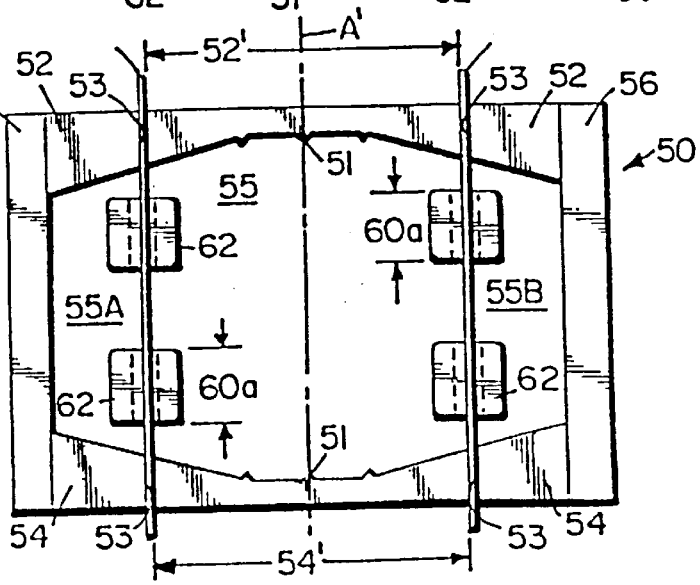
FIG. 12 is a top plan view of the masonry block mold shown in FIG. 11 in accordance with the present invention.

Once the fill is mixed, the fill is then loaded into a hopper which transports the fill to the mold 50 within the block machine, FIGS. 11 and 12.

The mold 50 generally comprises at least four sides bordering a central cavity. As can be seen in FIG. 12, the mold generally has a front wall 58, a back wall 56, and a first 52 and second 54 opposing side. The opposing sides (52, 54) are each generally stepped in area 53 having a depressed center length (52', 54') and an elevated higher end adjacent the front and back walls, FIG. 11. The central cavity 55 is bordered by these walls.

Core forms 62 may also be placed in the mold cavity 55 prior to loading the mold with block mix. Generally, the core forms 62 may be supported by bars 60 positioned across opposing first 52 and second 54 sidewalls and adjacent to the stepped regions 53 in each of these sidewalls.

Turning to the specific aspects of the mold, the mold functions to facilitate the formation of the blocks. Accordingly, the mold may comprise any material which will withstand the pressure to be applied to block fill by the head. Preferably, metals such as steel alloys having a Rockwell "C"-scale ranging from about 60–65 provide optimal wear resistance and the preferred rigidity. Generally, metals found useful in the manufacture of the mold of the present invention include high grade carbon steel 41–40 AISI (high nickel content, prehardened steel), carbon steel 40–50 (having added nickel) and the like. A preferred material includes carbon steel having a structural ASTM of A36.

The mold of the present invention may be made by any number of means known to those of skill in the art. Generally, the mold is produced by cutting the stock steel, patterning the cut steel, providing an initial weld to the patterned mold pieces and heat treating the mold. Heat treating generally may take place at temperatures ranging from 1000° F. to 1400° F. for 4 to 10 hours depending on the ability of the steel to withstand processing and not distort. After heat treating, final welds are then applied to the pieces of the mold.

Turning to the individual elements of the mold, the mold walls generally function according to their form by withstanding the pressure created by the press. Further, the walls measure the height and depth of the resulting blocks. Accordingly the mold walls must be made of a thickness which will accommodate the processing parameters of block formation given a specific mold composition. Preferably, the mold walls range in thickness from about 0.25 inch to about 2.0 inches, preferably from about 0.75 inch to 1.5 inches.

Additionally, the mold sidewalls function to ensure that uniform pressure is applied throughout the entire block during formation. Uniform pressure on all block elements is ensured by retaining additional block fill or mix adjacent the mold front 56 and back 58 wall in areas 55A and 55B, which will be the area in which the block flange 40 (FIGS. 3 and 6) is formed. By retaining mix in areas 55A and 55B, the same compression is applied to the mix which becomes the block body and to the mix which becomes the block flange. The application of uniform pressure to the block flange allows the construction of smaller blocks having smaller, stronger flanges. In turn, a smaller flange provides a block which results in a more vertical structure such as a wall having less setback from course to course and, as a result, greater stability over its height.

Generally, the mold sidewalls 52, 54 may take any form which provides this function. Preferably, the mold sidewalls 52, 54 are stepped 53 as can be seen in FIGS. 11 and 12. Turning to FIG. 11, mold sidewall 54 is stepped twice across its length in region 53 to create a depressed central length 54' in the sidewall 54. In FIG. 11, the mold 50 is shown during the actual block formation step, with the head 72 compressed onto the block fill in the mold 50.

The mold may preferably also comprise support bars 60 and core forms 62. The support bars 60 hold the core forms 62 in place and act as a stop for block fill or mix which is retained in the elevated (or stepped) region of the mold 50 thereby preventing the fill from flowing back into the area bordered by the depressed central lengths 52' and 54' of sidewalls 52 and 54. Here again, the support bars may take any shape, size material composition which provides these functions.

As can be seen more clearly in FIG. 12, support bar 60 is preferably long enough to span the width of mold 50 resting on opposing sidewalls 52 and 54. Preferably the support bars 60 are high enough to restrict the flow of fill into the central area of the mold cavity 55. Complementing this function, the support bars 60 are generally positioned in the depressed central areas 52' and 54' of the opposing sidewalls immediately adjacent stepped region 53, FIG. 12.

As can be seen in outline in FIG. 11, the core forms 62 are supported by bars 60 which span the width of the mold 50 resting on the opposing sidewalls 52, 54. The head 72 and head stamp 70 (also seen in outline (FIG. 11)) are patterned to avoid contact with the core forms 62 and support bars 60.

The core forms have a number of functions. The core forms 62 act to form voids in the resulting composite masonry block. In turn, the core forms lighten the blocks, reduce the amount of fill necessary to make a block and add a handle to the lower surface of the block which assists in transport and placement of the blocks. In concert with these functions the cores may take any number of forms. Preferably, the core forms are approximately three inches square and penetrate from about 60% to about 80% of the blocks height and most preferably about 70% to 80% of the block height. Also preferred, as can be seen in the exploded view provided in FIG. 13, the core forms 62 are affixed to the support bar 60 at insert regions 60A. These insert regions 60A assist in positioning the cores and during processing, reduce the build up of block mix or fill on the lower edge of the support bar 60. In turn, maintaining a support bar 60 clean of mix build up maintains the planarity of the lower surface of blocks formed in accordance with the present invention.

Figure 13:
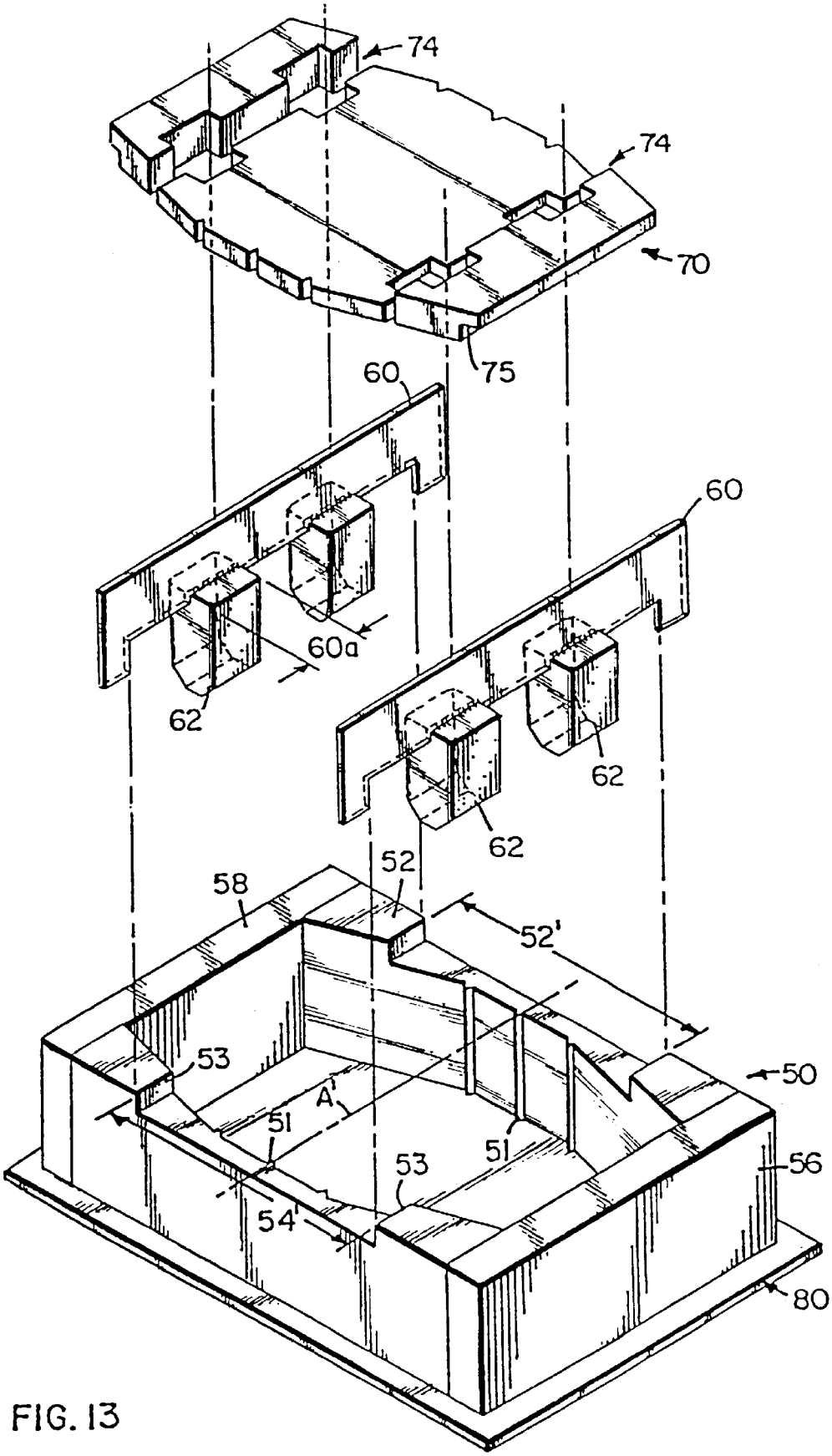
FIG. 13 is an exploded perspective view of one embodiment of the masonry block mold of the present invention showing application of the supporting bars, core forms, and stamp plate.

In operation, the mold 50 is generally positioned in a block molding machine atop a removable or slidable substrate 80, FIG. 13. The support bars 60 and core forms 62 are then placed into the mold 50. The mold 50 is then loaded with block mix or fill. As configured in FIG. 12, the mold 50 is set to form two blocks simultaneously in "siamese" pattern. As will be seen, once formed and cured, the blocks may be split along the edge created by flange 51 generally along axis A.

Prior to compression the upper surface of the mold 50 is scraped or raked with a feed box drawer (not shown) to remove excess fill. Scraping of the mold is preferably undertaken in a side-to-side direction in order to avoid contact with the side bars 60. Also, removal of the excess fill from the mold by scraping from the side allows for the depressed central lengths 52' and 54' of the mold and does not disturb the fill at the stepped ends of the mold 50.

The mold is then subjected to compression directly by head 70 (shown in outline complete in FIG. 11 and in perspective in FIG. 13). Preferably the head 70 is patterned 74 to avoid the support bars 60 and core forms 62. Also, as can be seen in FIG. 13, the head 70 preferably has an instep 75 which shape complements and results in, the formation of the block flange 40. Instead of relying on the head to force block fill towards either end of the mold 50 into instep 75 to create a flange, the mold 50 maintains fill in the stepped regions at either end of the mold 50. The fill in these regions comes into direct contact with instep 75 immediately upon lowering of the head 70. As a result, the fill in this stepped area is subjected to the same pressure as the fill in other areas of the mold. This results in a flange 40 of the same structural strength as the other elements of the block 15.

Once the mold has been filled, leveled by means such as a feed-box drawer, and agitated, a compression mechanism such as a head converges on the exposed surface of the fill. The head acts to compress the fill within the mold for a period of time sufficient to form a solid contiguous product. The head 70, as known to those of skill in the art, is a unit which has a pattern which mirrors the blocks and core forms 62 and is complementary to that of the mold 50. Generally, the compression time may be anywhere from ½ to 3 seconds and more preferably about 1.5 to about 2 seconds. The compression pressure applied by the head ranges from about 5000 to 8000 psi and preferably is about 7500 psi. Once a compression period is over, the head in combination with an underlying pallet 80 acts to strip the blocks 15 from the mold 50. At this point in time, the blocks are formed. Any block machine known to those of skill in the art may be used. One machine which has been found useful in the formation of blocks in accordance with the present invention is a Besser V-3/12 block machine.

Prior to compression the mold may be vibrated. Generally, the fill is transported from the mixer to a hopper which then fills the mold 50. The mold is then agitated for up to two or three seconds, the time necessary to ensure that the fill has uniformly spread throughout the mold. The blocks are then formed by the compressing action of the head.

Once the blocks are formed, they may be cured through any means known to those of skill in the art. Curing mechanisms such as simple air curing, autoclaving, steam curing or mist curing, are all useful methods of curing the block of the present invention. Air curing simply entails placing the blocks in an environment where they will be cured by the open air over time. Autoclaving entails placing the blocks in a pressurized chamber at an elevated temperature for a certain period of time. The pressure in the chamber is then increased by creating a steady mist in the chamber. After curing is complete the pressure is released from the chamber which in turn draws the moisture from the blocks.

Another means for curing blocks is by steam. The chamber temperature is slowly increased over two to three hours and then stabilized during the fourth hour. The steam is gradually shut down and the blocks are held at the eventual temperature, generally around 120°–200° F. for two to three hours. The heat is then turned off and the blocks are allowed to cool. In all instances, the blocks are generally allowed to sit for twelve to twenty-four hours before being stacked or stored. Critical to curing operations is a slow increase in temperature. If the temperature is increased too quickly, the blocks may "case-harden." Case-hardening occurs when the outer shell of the blocks hardens and cures while the inner region of the block remains uncured and moist. While any of these curing mechanisms will work, the preferred curing means is autoclaving.

Once cured, the blocks may be split if they have been cast "siamese" or in pairs. Splitting means which may be used in the method of the present invention include a manual chisel and hammer as well as machines known to those with skill in the art for such purposes. Splitting economizes the production of the blocks of the present invention by allowing the casting of more than one block at any given time. When cast in pairs, the blocks 15, FIG. 13, may be cast to have an inset groove created by flange 51 on their side surfaces between the two blocks. This groove provides a natural weak point or fault which facilitates the splitting action along axis A'. The blocks may be split in a manner which provides a front surface 22 which is smooth or coarse, single-faceted or multi-faceted, as well as planar or curved. Preferably, splitting will be completed by an automatic hydraulic splitter. Once split, the blocks may be cubed and stored.

The above discussion, examples, and embodiments illustrate our current understanding of the invention. However, since many variations of the invention can be made without departing from the spirit and scope of the invention, the invention resides wholly in the claims hereafter appended.

We claim as our invention:

1. A composite masonry block comprising:

a) a block body, said block body comprising a front surface and a back surface, said front surface and said back surface being substantially parallel to each other and separated by a distance comprising the depth of the block, a generally planar upper surface and a generally planar lower surface, said upper surface and said lower surface being substantially parallel to each other and separated by a distance comprising the height of the block, said lower surface having a smaller area than said upper surface, and opposed first and second sidewall surfaces, said sidewall surfaces adjoining said block upper and lower surfaces, each of said first and second sidewall surfaces comprising a first part and a second part, said sidewall surface first parts extending from said block front surface towards said block back surface, and intersecting the front surface at an angle of ninety degrees or less, said sidewall surface second parts joining their respective sidewall surface first parts and said block back surface, each sidewall surface second part intersecting the back surface at an angle of less than ninety degrees; and b) a flange extending from the block back surface past the height of the block, said flange comprising a setback surface and a locking surface, said setback surface extending from the lower rear edge of the flange towards said block front surface to adjoin said flange locking surface, said locking surface extending below the plane of said block lower surface;

c) wherein the top surface and the sidewall surfaces are generally solid and continuous across their entire extents.

2. A retaining wall block suitable for use in forming a mortarless retaining wall, said block comprising:

a) a pair of substantially parallel and planar upper and lower faces;

b) a front face joining the upper and lower faces, which is substantially perpendicular to the upper and lower faces;

c) a rear face which is substantially perpendicular to the upper and lower faces;

d) a pair of side faces joining the front and rear faces, the side faces being substantially perpendicular to the upper and lower faces, and including rearwardly converging portions, wherein a line drawn on the upper face through the points where the rearwardly converging portions begin is substantially parallel to a line drawn through the points where the side faces join the rear face; and e) a flange extending below the lower face of the block, said flange having a rear face which is substantially an extension of the rear face of the block, said flange further including a front locking surface which intersects the lower face of the block;

f) wherein the upper face and the side faces are substantially solid and continuous throughout their extents;

g) and wherein the area of the upper face is greater than the area of the lower face.

3. The block of claim 2 wherein the depth of the block is the distance between the midpoint of the front face and the midpoint of the rear face, wherein the depth of the flange is the distance between the front locking surface of the flange and the rear surface of the flange, and wherein the ratio of the depth of the block to the depth of the flange is at least about 6:1.

4. The block of claim 3 wherein the ratio is at least about 10:1.

5. The block of claim 3 wherein the front face of the block is substantially planar.

6. The block of claim 3 wherein the front face of the block is nonplanar.

7. The block of claim 6 wherein the front face of the block is faceted.

8. The block of claim 6 wherein the front face of the block is curved.

9. The block of claim 2, wherein said flange spans between said side faces.

10. A retaining wall comprising stacked courses of the block of claim 2 in which the front faces of the blocks combine to form a decorative face of the retaining wall, and wherein the lower face of each block in a succeeding course is placed over the upper faces of the blocks in the next lower course, with the downwardly-extending flanges of each block in a succeeding course being positioned immediately behind the uppermost portions of the rear faces of the blocks in the next lower course.

11. A retaining wall comprising stacked courses of the block of claim 3 in which the front faces of the blocks combine to form a decorative face of the retaining wall, and wherein the lower face of each block in a succeeding course is placed over the upper faces of the blocks in the next lower course, with the downwardly-extending flanges of each block in a succeeding course being positioned immediately behind the uppermost portions of the rear faces of the blocks in the next lower course.

12. A retaining wall comprising stacked courses of the block of claim 4 in which the front faces of the blocks combine to form a decorative face of the retaining wall, and wherein the lower face of each block in a succeeding course is placed over the upper faces of the blocks in the next lower course, with the downwardly-extending flanges of each block in a succeeding course being positioned immediately behind the uppermost portions of the rear faces of the blocks in the next lower course.

13. A retaining wall comprising stacked courses of the block of claim 9 in which the front faces of the blocks combine to form a decorative face of the retaining wall, and wherein the lower face of each block in a succeeding course is placed over the upper faces of the blocks in the next lower course, with the downwardly-extending flanges of each block in a succeeding course being positioned immediately behind the uppermost portions of the rear faces of the blocks in the next lower course.

14. The retaining wall of claim 10, comprising a first course and an adjacently positioned upper second course.

15. The retaining wall of claim 14, wherein said retaining wall has a set back from said first course to said second course.

16. The retaining wall of claim 15, wherein said retaining wall set back ranges from about 1 to 2 inches from said first course to said second course.

17. The retaining wall of claim 14, wherein said retaining wall comprises a supporting matrix positioned between said first course and said second course.

18. A retaining wall comprising stacked courses of the block of claim 5 in which the front faces of the blocks combine to form a decorative face of the retaining wall, and wherein the lower face of each block in a succeeding course is placed over the upper faces of the blocks in the next lower course, with the downwardly-extending flanges of each block in a succeeding course being positioned immediately behind the uppermost portions of the rear faces of the blocks in the next lower course.

19. A retaining wall comprising stacked courses of the block of claim 6 in which the front faces of the blocks combine to form a decorative face of the retaining wall, and wherein the lower face of each block in a succeeding course is placed over the upper faces of the blocks in the next lower course, with the downwardly-extending flanges of each block in a succeeding course being positioned immediately behind the uppermost portions of the rear faces of the blocks in the next lower course.

20. A retaining wall comprising stacked courses of the block of claim 7 in which the front faces of the blocks combine to form a decorative face of the retaining wall, and wherein the lower face of each block in a succeeding course is placed over the upper faces of the blocks in the next lower course, with the downwardly-extending flanges of each block in a succeeding course being positioned immediately behind the uppermost portions of the rear faces of the blocks in the next lower course.

21. A retaining wall comprising stacked courses of the block of claim 8 in which the front faces of the blocks combine to form a decorative face of the retaining wall, and wherein the lower face of each block in a succeeding course is placed over the upper faces of the blocks in the next lower course, with the downwardly-extending flanges of each block in a succeeding course being positioned immediately behind the uppermost portions of the rear faces of the blocks in the next lower course.

22. The block of claim 2 wherein the rear face of the block includes a substantially planar portion which is parallel to the line drawn through the points where the side faces join the rear face of the block.

23. The block of claim 22 wherein the front locking surface of the flange includes a substantially planar portion which is substantially parallel to the substantially planar portion of the rear face of the block.

24. The block of claim 23 wherein each side face further includes a forwardly converging portion that intersects the front face at an angle of less than 90 degrees.

25. The block of claim 24 wherein the rearwardly converging side face portions each intersect the rear face at an angle of less than 90 degrees.

26. The block of claim 25 wherein the rearwardly converging side face portions each intersect the rear face at an angle between about 30 degrees and about 60 degrees.

27. The block of claim 24 wherein the ratio of the front-to-back depth of the block to the depth of the flange is at least about 6:1.

28. A composite masonry block suitable for use in forming straight and serpentine retaining walls having a set back from course to course, said block comprising:

a) a block body and an integral locator lip formed in a mold with generally vertical sidewalls, an open top and an open bottom seated upon a generally horizontal flat pallet, by a process comprising the steps of:

i) filling the mold via its open top with a masonry block mix comprising sand, aggregate, and cement;

ii) vibrating the masonry block mix within the filled mold;

iii) compacting the masonry block mix within the mold by the action of a compression head pushed down on the masonry block mix through the open top of the mold, whereby the masonry block mix forms an uncured unit having the shape imparted to it by the mold, the pallet on which the mold rests, and the compression head;

iv) stripping the uncured unit from the mold via the open bottom of the mold by the combined, relative vertical action of the compression head and the pallet with respect to the mold, whereby, after stripping, the uncured unit rests on the pallet unsupported by the mold;

v) transporting the uncured unit to a curing location;

vi) curing the uncured unit at the curing location to create a cured unit;

vii) transporting the cured unit from the curing location to a splitting location; and viii) splitting the cured unit transversely to form at least one finished composite masonry block;

b) said block body comprising:

i) a generally horizontal upper surface;

ii) a generally horizontal lower surface having a smaller gross area than that of the upper surface;

iii) a generally vertical front surface;

iv) a generally vertical back surface, said front and back surfaces being separated by a distance comprising the depth of the block;

v) a generally vertical first sidewall extending from the front surface to the rear surface, and extending from the upper surface to the lower surface, said first sidewall including a first part that extends away from the front surface at an external angle of less than ninety degrees with respect to the front surface, and a generally planar second part that lies between the sidewall first part and the back surface, and intersects the back surface at an external angle of less than 90 degrees; and vi) a generally vertical second sidewall opposed to the first sidewall, and extending from the front surface to the back surface, and extending from the upper surface to the lower surface, said second sidewall including a first part that extends away from the front surface at an external angle of less than 90 degrees with respect to the front surface, and a generally planar second part that lies between the sidewall first part and the back surface, and intersects the back surface at an external angle of less than 90 degrees;

vii) said block body upper surface being formed by the pallet upon which the mold seats during the molding process, and being substantially planar, substantially solid, and substantially continuous across its whole extent from its intersections with the front surface, the back surface, and each sidewall as a result;

viii) said block body lower surface being formed by the compression head during the molding process, and being substantially planar as a result;

ix) the second parts of the block body sidewalls being formed by the corresponding vertical walls of the mold during the molding process, and being substantially solid and continuous across their whole extents as a result;

x) said block body back surface being formed by corresponding vertical walls of the mold during the molding process;

c) said integral locator lip including a back surface which is an extension of the back surface of the block body, and a forwardly facing locking surface which extends below the lower surface of the block body, the depth of said locator lip being the distance between its locking surface and its back surface measured in the plane of the lower surface of the block body, and wherein the ratio of the depth of the block body to the depth of the locator lip is at least about 6:1;

i) wherein the locking surface is formed by a corresponding surface of the compression head during the molding process.

29. The composite masonry block of claim 28 wherein the block body front surface is formed by the action of one or more splitter blades which are oriented generally perpendicularly to the upper and lower surfaces of the block body when the cured unit is at the splitting location, and, as a consequence, said block body front surface is irregular, but generally rectangular and generally planar within the limits of the splitting process to produce such a surface.

30. The composite masonry block of claim 28 wherein the block body sidewall first parts are formed by the action of one or more splitter blades which are oriented generally perpendicularly to the upper and lower surfaces of the block body when the cured unit is at the splitting location, and, as a consequence, said sidewall first parts are irregular, but generally rectangular and generally planar within the limits of the splitting process to produce such a surface.

31. The composite masonry block of claim 30 wherein the sidewall first parts intersect the sidewall second parts at a distance from the front surface equal to between about one fifth and about one quarter of the depth of the block body.

32. The composite masonry block of claim 28 wherein the locator lip is continuous, and extends substantially from sidewall to sidewall.

33. The composite masonry block of claim 28, wherein the cured unit is split to form at least two finished composite masonry blocks.

34. The composite masonry block of claim 28 wherein the cured unit is transported from the curing location to a storage location prior to being transported to a splitting location.

35. The composite masonry block of claim 28 wherein the cured unit is transported directly from the curing location to a storage location prior to being transported to a splitting location.

36. The composite masonry block of claim 28 wherein the cured unit is transported directly from the curing location to a splitting location.

37. The composite masonry block of claim 28 wherein the locator lip comprises a setback surface between the locking surface and the back surface of the lip, which is formed by a corresponding surface of the compression head during the molding process.

38. A composite masonry block suitable for landscape applications, comprising:

a) a solid and generally planar top face;

b) a bottom face which is generally parallel to the top face;

c) a rear face which is generally perpendicular to the top and bottom faces;

d) a front face which is generally perpendicular to the top and bottom faces, and which includes opposed portions which diverge as they extend towards the rear face of the block;

e) opposed solid side faces which are generally perpendicular to the top and bottom faces, each of said solid side faces extending from an opposed diverging portion of the front face to the rear face, said side faces converging as they extend towards the rear face;

f) a lower rear locator lip formed integrally with the bottom face of the block, and located adjacent to the rear face of the block, so that the lip is adapted to establish a uniform setback from course to course when a plurality of like blocks are laid in courses, and comprises a rear face which is an extension of the block rear face below the bottom face of the block.

39. The block of claim 38 wherein the opposed diverging portions of the front face are generally planar.

40. The block of claim 38 wherein the rear face is generally planar.

41. A concrete block suitable for constructing straight and curved retaining walls without pins or mortar, and capable of being mass produced by automated block-making machines, said block consisting essentially of:

a) a block body having a generally horizontal and substantially planar upper surface and a generally horizontal and substantially planar lower surface, said upper surface and said lower surface being substantially parallel to each other and separated by a vertical distance which is the height of the block;

b) said block body having a generally vertical first front surface and a generally vertical back surface, said first front surface and said back surface being substantially parallel to each other and generally perpendicular to said upper and lower surfaces of said block, said first front and back surfaces being separated by a horizontal distance comprising the depth of the block;

c) a flange or lip integrally formed with the block and extending downwardly from the lower surface of the block along intersection of the lower surface of the block with the back surface of the block to a point below the lower surface of the block, the rear face of the flange being an extension of the back surface of the block, said flange comprising a lower setback surface and a forward-facing locking surface;

d) said lower surface having a smaller surface area for block-to-block contact than the surface area of said upper surface, said smaller surface area being the result of the formation of the flange on the lower surface;

e) said block having generally vertical two-part left and right sidewall surfaces, each of said left and right sidewall surfaces comprising a substantially planar first or front part and a substantially planar second or rear part, said first parts having surfaces which do not diverge relative to each other in the direction of said block front surface, and said second or rear parts having surfaces which converge in the direction of said block back surface; and f) the top surface and both sidewall surfaces of said block being substantially solid and continuous across their entire extents.

42. The block of claim 41 wherein each of said front parts of said side surfaces converges toward the first front face, said front parts of said side surfaces functioning as additional front faces for the block.

43. The block of claim 42 wherein each of said front parts of said side surfaces is a split face and wherein the first front face of the block is also a split face.

44. The block of claim 41 wherein each of said front parts of said side surfaces is substantially perpendicular to the first front face.

45. The block of any of claims 41–44 wherein the rearwardly converging side surfaces each intersect the back surface of the block at an angle between about 30 degrees and about 60 degrees.

46. The block of claim 40 wherein the ratio of the front-to-back depth of the block to the depth of the flange is at least about 6:1.

47. The block of claim 1 wherein the sidewall surfaces include one or more notches.

48. The block of claim 2 wherein the sidewall surfaces include one or more notches.

49. The composite masonry block of claim 28 wherein the vertical mold surfaces corresponding to the block body sidewalls comprise one or more vertical flanges, and the block body sidewalls include a corresponding number of vertical grooves as a consequence of the molding process.

50. A composite masonry block suitable for landscape applications, comprising:

a) a solid and generally planar top face;

b) a bottom face which is generally parallel to the top face;

c) a rear face which is generally perpendicular to the top and bottom faces;

d) a front face which is generally perpendicular to the top and bottom faces, and which includes opposed portions which diverge as the extend towards the rear face of the block;

e) opposed solid side faces which are generally perpendicular to the top and bottom faces, each of said solid side faces being located between the front face and the rear face, and including portions which converge as they extend towards the rear face;

f) a lower rear locator lip formed integrally with the bottom face of the block, and located adjacent to the rear face of the block, so that the lip is adapted to establish a uniform set back from course to course when a plurality of like blocks are laid in courses, and comprises a rear face which is an extension of the block rear face below the bottom face of the block.

51. The composite masonry block of claim 50 wherein the converging portions of the side faces extend from the respective opposed diverging portions of the front face to the rear face.

* * * * *

US005827015C1

(12) EX PARTE REEXAMINATION CERTIFICATE (5465th)

United States Patent

Woolford et al.

(10) Number: US 5,827,015 C1

(45) Certificate Issued: Aug. 1, 2006

(54) COMPOSITE MASONRY BLOCK

(75) Inventors: Michael E. Woolford, Lake Elmo, MN (US); Dick J. Slevert, New Richmond, WI (US)

(73) Assignee: Anchor Wall Systems, Inc., Minnetonka, MN (US)

Reexamination Request:
No. 90/007,385, Jan. 21, 2005

Reexamination Certificate for:

| | |
|---|---|
| Patent No.: | **5,827,015** |
| Issued: | **Oct. 27, 1998** |
| Appl. No.: | **08/921,481** |
| Filed: | **Sep. 2, 1997** |

Related U.S. Application Data

(63) Continuation of application No. 08/675,572, filed on Jul. 3, 1996, now abandoned, which is a continuation of application No. 08/469,795, filed on Jun. 6, 1995, now Pat. No. 5,589,124, which is a continuation of application No. 08/157,830, filed on Nov. 24, 1993, now abandoned, which is a division of application No. 07/651,322, filed on Feb. 6, 1991, now Pat. No. 5,294,216, which is a division of application No. 07/534,831, filed on Jun. 7, 1990, now Pat. No. 5,062,610, which is a continuation-in-part of application No. 07/413,400, filed on Sep. 27, 1989, now abandoned, which is a continuation-in-part of application No. 07/413,050, filed on Sep. 27, 1989, now abandoned.

(51) Int. Cl.

| | |
|---|---|
| ***E04C 1/00*** | (2006.01) |
| ***E04C 1/39*** | (2006.01) |
| ***E04B 2/02*** | (2006.01) |
| ***B28B 17/00*** | (2006.01) |
| ***B28B 7/16*** | (2006.01) |
| ***B28B 7/00*** | (2006.01) |

(52) U.S. Cl. ..... 405/286; 52/608; 405/284

(58) Field of Classification Search ..... None
See application file for complete search history.

(56) References Cited

U.S. PATENT DOCUMENTS

| | | | | | |
|---|---|---|---|---|---|
| 787,199 | A | * | 4/1905 | Lloyd | 264/157 |
| 1,905,975 | A | * | 4/1933 | Thomas | 425/89 |
| 2,313,363 | A | * | 3/1943 | Schmitt | 405/286 |
| 3,925,994 | A | * | 12/1975 | Broms et al. | 405/302.7 |
| 4,335,549 | A | * | 6/1982 | Dean, Jr. | 52/98 |
| 4,616,959 | A | * | 10/1986 | Hilfiker | 405/286 |
| D296,007 | S | * | 5/1988 | Forsberg | D25/116 |
| D299,067 | S | * | 12/1988 | Forsberg | D25/58 |
| 4,825,619 | A | * | 5/1989 | Forsberg | 405/286 |
| 4,914,876 | A | * | 4/1990 | Forsberg | 405/286 |
| 6,142,713 | A | * | 11/2000 | Woolford et al. | 405/286 |
| 6,183,168 | B1 | * | 2/2001 | Woolford et al. | 405/286 |
| 6,312,197 | B1 | * | 11/2001 | Woolford et al. | 405/286 |

FOREIGN PATENT DOCUMENTS

CH 663437 A5 * 12/1987

OTHER PUBLICATIONS

"Beautiful Do–It–Yourself Retaining Walls!", date unknown.*

"Introducing the Keystone Retaining Wall Systems", date unknown.*

Applicants's admission of prior art (see '015 file history), date of either Jul. 13, 1996 or May 8, 1997.*

"Garden Walls" (Beautiful Do–It–Yourself Retaining Walls!), Keystone Retaining Wall Systems, Inc., copyright Mar. 20, 1989 (copyright registration number TX2807652), 1–page brochure.*

"Garden Walls" (Introducing the Keystone Retaining Wall Systems), Keystone Retaining Wall Systems, Inc., copyright May 29, 1989 (copyright registration number TX2798584), 1–page brochure.*

"Diamond Wall System" (TECH SPEC), Anchor Block Company and Oscar Roberts Concrete Products, Sep. 1988, 2 pages.*

Declaration of Al Pfannenstein submitted in the Australian Opposition proceedings, dated Aug. 28, 1998.

House Report 101–120, 107th Congress, 1st Session, regarding Substantial New Question of Patentability in Reexamination Proceedings, dated Jun. 28, 2001.

Amended and Verified Response, verified on May 6, 1997, and submitted in U.S. Appl. No. 08/675,572.

Information Disclosure Statement, dated Nov. 12, 1997, submitted in U.S. Appl. No. 08/921,481.

Information Disclosure Statement, dated Jun. 3, 1999, submitted in U.S. Appl. No. 09/160,916.

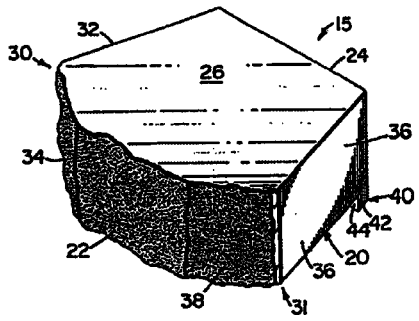

USPTO Office Action Rejection, dated Jul. 19, 1999, in U.S. Appl. No. 09/160,916.
Amendment and Response, dated Nov. 8, 1999, submitted in U.S. Appl. No. 09/160,916.
USPTO Notice of Allowability, dated Dec. 20, 1999, in U.S. Appl. No. 09/160,916.
Comments of Statement of Reasons for Allowance, dated Jan. 28, 2000, filed in U.S. Appl. No. 09/160,916.
U.S. Copyright Document No. TX 2 807 652, filed on Jan. 30, 1990, which was submitted with the Information Disclosure Statement of Exhibit 7.
U.S. Copyright Document No. TX 2 798 584, filed on Jan. 30, 1990, which was submitted with the Information Disclosure Statement of Exhibit 7.
Keystone memos relating to a meeting with Menards in Mar. of 1989.
Selected pages of the Deposition Transcript of Robert A. McDonald that were submitted with the Information Disclosure Statement of Exhibit 7.
Selected pages of the Deposition Transcript of Paul Forsberg that were submitted with the Information Disclosure Statement of Exhibit 71.
Selected pages of the Deposition of Paul Forsberg that was taken by counsel for the Reexamination Requester counsel in 2003.
Australian patent that is referenced by Reexamination Requester in its Petition.
Keystone brochure entitled "Beautiful Do–It–Yourself Results," Library of Congress, Jun. 27, 1988, 2 pages.
Johnson Block Product documentation, 2 pages.
Handy–Stone product literature bearing a copyright date of 1989, 3 pages.
A copy of a protest filed in U.S. Appl. No. 07/485,736, 10 pages.
A copy of a Petition to Make Special Because of Actual Infringement filed during prosecution of U.S. Pat. No. 5,294,216, 2 pages.
A copy of a Declaration by Glenn Bolles filed during prosecution of U.S. Pat. No. 5,294,216, 4 pages.
Rockwood E–Z Wall block brochure, 1989, 4 pages.
Summary of allegations as to date of publication of "Johnson Block" Product Literature, 3 pages.
Information regarding copyright notice on "Handy–Stone Retaining Wall System" Product Literature, 1 page.
Summary of allegations as to date of publication of "EZ Wall Systems" Product Literature, 1 page.
Alleged Johnson Block price lists received from Rockwood Retaining Walls in *Anchor Wall Systems, Inc.* v. *Rockwood Retaining Walls, Inc. et al.,* United States District Court, District of Minnesota, Civ. No. 99–CV–1356, 4 pages.
Copy of deposition testimony of Mr. Richard Stehly, pp. 1 and 89, in *Anchor Wall Systems, Inc.* v. *Rockwood Retaining Walls, Inc. et al.,* United States District Court, District of Minnesota, Civ. No. 99–CV–1356.
Copy of Affidavit Of Richard D. Stehly, in *Anchor Wall Systems, Inc.* v. *Concrete Products of New London, Inc.,* United States District Court, District of Minnesota, Civ. No. 03–CV–3271, pp. 1 and 4.
Copies of deposition testimony of Mrs. Therese Hovanec, pp. 1, 13–20 and 89–92, in *Anchor Wall Systems, Inc.* v. *Concrete Products of New London, Inc.,* United States District Court, District of Minnesota, Civ. No. 03–CV–3271.
Copy of an affidavit executed by Mr. Ray Price and two exhibits mentioned in the Price affidavit, from the matter *Anchor Wall Systems, Inc.* v. *Concrete Products of New London, Inc.,* United States District Court, District of Minnesota, Civ. No. 03–CV–3271, 7 pages.
Copies of deposition testimony of Mr. Floyd Johnson, pp. 1, 60–63 and 70–71, in *Anchor Wall Systems, Inc.* v. *Concrete Products of New London, Inc.,* United States District Court, District of Minnesota, Civ. No. 03–CV–3271.
A sheet labeled "Flow Chart" that summarizes the series of patents and applications related to this patent, 1 page.
Print outs of photographs of Loffelstein blocks alleged to be dated as early as 1982, 1 page.
A copy of a memorandum from Gene F. Ernst to Paul Forsberg dated Oct. 6, 1987, 1 page.
A copy of the reply filed by Anchor Wall Systems, Inc. in response to the petition filed by Keystone Retaining Wall Systems, Inc. against Australian Petty Patent 650,230.
A copy of a decision by the Australian Intellectual Property Office in response to the petition filed by Keystone Retaining Wall Systems, Inc. against Australian Petty Patent 650,230.
A copy of an affidavit by Carl Moy submitted by Anchor Wall Systems, Inc. in response to the petition filed by Keystone Retaining Wall Systems, Inc. against Australian Petty Patent 650,230, Aug. 11, 1995, 6 pages.
A copy of an affidavit by Carl Moy submitted by Anchor Wall Systems, Inc. in *Anchor Wall Systems et al.* v. *Boral et al.,* Federal Court of Australia, Queensland District Registry, General Division, QG29 of 1995, Sep. 20, 1996, 15 pages.
A copy of an opposition filed by Keystone Retaining Wall Systems, Inc. opposing the issuance of Australian Patent Application No. 684,211.
Letter from Bradley J. Thorson to Julie Daulton dated Feb. 28, 2006, with attached press release entitled Anchor Wall Systems Conducts Extensive Research Among Landscape Audiences.
Request for Ex Parte Reexamination of U.S. Pat. No. 6,183,168 dated Mar. 7, 2006 by Bradley J. Thorson, with Exhibits 1–4.

* cited by examiner

*Primary Examiner*—Peter C. English

(57) ABSTRACT

The present invention includes block molds and manufacturing processes as well as a composite masonry block comprising a block body having an irregular trapezoidal shape and comprising a front surface and a back surface, an upper surface and a lower surface, and first and second sidewalls. Both the first and second sidewalls have a first and second part, the sidewall first part extends from the block front surface towards the block back surface at an angle of no greater than ninety degrees in relationship to the block front surface, the sidewall second part surfaces adjoins and lies between the sidewall first parts and the block back surface. The block also has a flange extending from the block back surface past the height of the block.

Also disclosed are landscaping structures such as a retaining wall comprising a plurality of the composite masonry blocks of the present invention.

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–51 is confirmed.

* * * * *